United States Patent [19]

Lemke

[11] Patent Number: 4,824,383

[45] Date of Patent: Apr. 25, 1989

[54] TERMINATOR AND CORRESPONDING RECEPTACLE FOR MULTIPLE ELECTRICAL CONDUCTORS

[75] Inventor: Timothy A. Lemke, Carlisle, Pa.

[73] Assignee: E. I. Du Pont de Nemours and Company, Wilmington, Del.

[21] Appl. No.: 193,611

[22] Filed: May 13, 1988

Related U.S. Application Data

[63] Continuation-in-part of Ser. No. 91,002, Sep. 2, 1987, abandoned, which is a continuation-in-part of Ser. No. 932,921, Nov. 18, 1986, abandoned.

[51] Int. Cl.[4] ..... H01R 4/66

[52] U.S. Cl. ..... 439/108; 439/608; 439/676

[58] Field of Search ..... 439/92, 93, 95–99, 439/108, 607–610, 626, 629, 630, 632, 638, 639, 660, 676, 677, 680, 681, 344

[56] References Cited

U.S. PATENT DOCUMENTS

| | | | |
|---|---|---|---|
| Re. 27,463 | 8/1972 | Sitzler et al. | 339/59 R |
| 3,325,771 | 6/1967 | Ruehlemann et al. | 439/681 |
| 3,430,185 | 2/1969 | Sitzler et al. | 339/59 |
| 3,517,375 | 6/1970 | Mancini | 339/177 |
| 3,539,974 | 11/1970 | Berg | 339/157 |
| 3,601,772 | 8/1971 | Mancini | 339/156 R |
| 3,634,814 | 1/1972 | Inacker | 339/176 MP |
| 3,654,592 | 4/1972 | Primorac | 339/176 MP |
| 3,696,319 | 10/1972 | Olsson | 339/17 F |
| 3,697,933 | 10/1972 | Black et al. | 339/192 R |
| 3,781,760 | 12/1973 | Mancini et al. | 339/59 M |
| 3,894,784 | 7/1975 | Clewes | 439/629 |
| 3,926,497 | 12/1975 | Eigenbrode | 339/91 R |
| 3,941,448 | 3/1976 | Evans | 339/176 MF |
| 4,092,058 | 5/1978 | Eigenbrode | 339/218 M |
| 4,109,986 | 8/1978 | Mouissie | 339/17 L |
| 4,174,877 | 11/1979 | Foederer | 339/97 P |
| 4,248,491 | 2/1981 | Mouissie | 339/17 F |
| 4,274,699 | 6/1981 | Keim | 339/176 MP |
| 4,368,939 | 1/1983 | Foederer | 339/59 M |
| 4,398,780 | 8/1983 | Novotny et al. | 439/610 |
| 4,406,512 | 9/1983 | Schell | 339/177 R |
| 4,416,501 | 11/1983 | Fusselman et al. | 339/97 R |
| 4,448,467 | 5/1984 | Weidler | 439/687 |
| 4,558,917 | 12/1985 | Kamono et al. | 339/143 R |
| 4,585,285 | 4/1986 | Martens | 439/108 |
| 4,585,288 | 4/1986 | Aikens | 339/75 MP |
| 4,592,612 | 6/1986 | Kikuta | 439/610 |
| 4,601,527 | 7/1986 | Lemke | 339/14 R |
| 4,605,276 | 8/1986 | Hasircoglu | 339/176 MF |
| 4,618,202 | 10/1986 | Libregts | 339/99 R |
| 4,632,486 | 12/1986 | Hasircoglu | 339/99 R |
| 4,639,067 | 1/1987 | Kikuta | 439/610 |
| 4,641,902 | 2/1987 | Fusselman | 339/91 R |
| 4,671,601 | 6/1987 | Lomecka | 439/404 |
| 4,687,267 | 8/1987 | Header et al. | 439/62 |

OTHER PUBLICATIONS

Selected pages of DuPont Catalog 86–A.

*Primary Examiner*—Gary F. Paumen

[57] ABSTRACT

A terminator for a multiple conductors includes a ground structure with generally U-shaped channels. The channel receives an insulated finger having an electrical contact element. When connected to ground potential the contacts are electrically isolated from each other.

39 Claims, 18 Drawing Sheets

TERMINATOR AND CORRESPONDING RECEPTACLE FOR MULTIPLE ELECTRICAL CONDUCTORS

CROSS-REFERENCE TO RELATED APPLICATIONS

This application is a continuation-in-part of copending application Ser. No. 091,002, filed Sept. 2, 1987, now abandoned, which is itself a continuation-in-part of application Ser. No. 932,921, filed Nov. 18, 1986, now abandoned.

BACKGROUND OF THE INVENTION

The present invention relates to a terminator having electrical contacts therein each connectable to one of a multiplicity of electrical conductors, and in particular, to a terminator having a ground structure therein arranged to isolate each electrical contact. In addition, the present invention relates to a receptacle structure useful with the terminator.

DESCRIPTION OF THE PRIOR ART

As the performance of electronic devices has increased exponentially it has become recognized in the art that the transmission of electrical signals, whether within a given electronic apparatus or between coupled apparatuses, must be approached from a system viewpoint. Such a viewpoint mandates that not only must each individual component in the signal transmission system be optimized for high speed operation but also the interfaces between components in the transmission system must be able to perform interactively without degrading the performance of an adjacent component.

One of the first components in the signal transmission system to receive attention is the transmission cable itself. The realization has been made that the cable handling the high speed signals is the electrical equivalent of a transmission line in that it extends an electrically great distance with respect to the wavelength of the transmitted signals. This is true even though in most instances the cable extends only a physically short distance between components to a given apparatus or between cooperating apparatus.

The design of electrical cable has advanced to a point wherein the cable can be precisely engineered to exhibit predetermined electrical properties. Exemplary of such cable structure is that disclosed and claimed in copending application Ser. No. 067,767, filed July 8, 1987, assigned to the assignee of the present invention. The cable disclosed in the last-mentioned application includes a corrugated ground structure which defines separate enclosed regions, or envelopes, which extend throughout the entire length of the cable. Each of the envelopes receives one or more ordinary jacketed conductors. When the ground structure is connected to a predetermined electrical potential the conductor in each envelope is isolated totally from those conductors disposed in adjacent envelopes. As a result such a cable exhibits electrical properties closely similar to those attainable from coaxial cable despite the fact that only ordinary jacketed conductors are utilized.

The system viewpoint has expanded to include considerations of electrical performance in the transition region intermediate the end of the cable and the cable terminator. The connector structure disclosed and claimed U.S. Pat. No. 4,731,031, assigned to the assignee of the present invention, utilizes a ground plane spaced predetermined distances from the ends of the conductors in the cable, the contacts in the connector and the interconnection therebetween for the purpose of minimizing electrical discontinuities in the system.

Density of the terminator, that is, the number of signals that can pass through a given terminator, is also an important consideration. In conventional systems attempts have been made to extend the shielding and control the impedance of the system beyond the transmission line by simply dedicating alternating contacts in the linear array of contacts in the terminator as ground contacts. The contact is not physically altered, but is merely designated as a ground contact and connected to a predetermined ground potential. The net result of these factors is that the density of the terminator is limited.

In view of the foregoing it is believed advantageous to further extend the system concept to the individual terminator of the transmission system and/or to the corresponding receptacle therefor. It is also believed advantageous to do so in a way that increases the density of the terminator. Accordingly, it is believed to be of advantage to provide a terminator for either a multiple conductor cable or a multiple tracing substrate that electrically isolates individual or groups of contact elements in the terminator to prevent or minimize cross talk between adjacent conductors and to prevent or minimize degradation of signal transmission. In addition, it is believed advantageous to provide the isolating structure in the terminator in such a fashion that the contacts need not themselves be included as part of the isolating structure whereby the signal density of the terminator may be increased. It is also believed advantageous to provide a corresponding receptacle structure for the plug terminator, and which must advantageously include a structure in the receptacle which isolates the contacts therein to minimize cross-talk and signal degradation.

SUMMARY OF THE INVENTION

The present invention relates, in one aspect, to a terminator for a multiple conductor electrical transmission system in which a ground structure is provided which electrically isolates individual or groups of adjacent electrical contact elements disposed in the terminator. The terminator may be implemented in a form that terminates a multiconductor cable or in a form that provides a terminator for a multiple tracing substrate. The terminator is thus adapted to interconnect in substrate-to-substrate, cable-to-cable, or cable-to-substrate form.

In either form the terminator includes a metallic ground structure having a baseplate with at least one but preferably a plurality of walls that extend upwardly from a surface of the baseplate. In the preferred case a series of walls also extends from the opposite surface of the baseplate. The walls cooperate to define a plurality of channels that extend in side-by-side relationship across the surface of the baseplate. An insulated support structure having a body portion with an array of extending fingers is mounted on the baseplate with the fingers extending into the channels on the baseplate. An individual electrical contact element or, if desired, a group of a predetermined number of contact elements is mounted on each of the fingers. In one arrangement the fingers may each be provided with a recess in which an individual electrical contact or group of electric contacts is disposed. The walls on the baseplate extend above the baseplate for a greater distance than do the electrical contacts. As a result, with the ground structure connected to a predetermined potential, each of the individual contacts or each group of contacts is electrically isolated from the adjacent contact or group of contacts, as the case may be, thus preventing or minimizing cross talk therebetween.

As noted the terminator can be implemented in a form suitable for the edge terminator of a substrate such as a circuit board, or as a plug terminator for a multiple conductor cable. In the former instance the ground structure is provided with a suitable mounting arrangement whereby the ground structure may be mounted in edgewise relationship to the substrate. In the latter instance a suitable housing is provided to define the plug portion. In one instance the portion of the ground structure having the walls thereon and the extending fingers of the insulated support structure project forwardly from the housing. In another instance the housing is coextensive with the forward face of the insulated support structure and the ground structure. The insulating support structure may be provided with trenches therein which receive the individual conductors of the cable. Alternatively the wires of the conductors may be facially welded to the contacts.

In another aspect the invention relates to a receptacle housing for a terminator. In one embodiment the receptacle housing has an array of lands separated in one instance by alternate grooves or, in another instance, by alternate slots. The lands carry electrical contact elements thereon. In the arrangement in which the grooves are used a separate array of contact elements is provided in the grooves. In the arrangement with the slotted housing, the exterior of the housing is provided with a ground plate that communicates with at least one of the slots. In each instance the housing is connectable to the plug such that the signal carrying contacts disposed within the channels on the ground structure are electrically interengaged with the contact elements on the lands. The walls of the ground structure are disposed in electrical contact with either the contacts provided in the grooves or the plate overlying the slots. When conjoined the plug and housing provides electrical shielding for the contact elements in the terminator (in either the cable plug form or the edge card form), thus preventing or minimizing cross talk and degradation and maintaining electrical signal integrity.

In an alternate embodiment of the receptacle the contacts of the receptacle are arranged in first and second generally linear arrays. The receptacle includes a central plate provided within the body thereof. The plate runs generally parallel to the arrays of contacts and, when connected to a predetermined potential, serves isolate the first contact array from the second contact array. The plate is arranged such that when the terminator having the ground structure therein is received within the receptacle the ground structure abuts the plate.

BRIEF DESCRIPTION OF THE DRAWINGS

The invention will be more fully understood from the following detailed description thereof, taken in connection with the accompanying drawings which form a part of this application and in which.

DETAILED DESCRIPTION OF THE INVENTION

Figure 1:
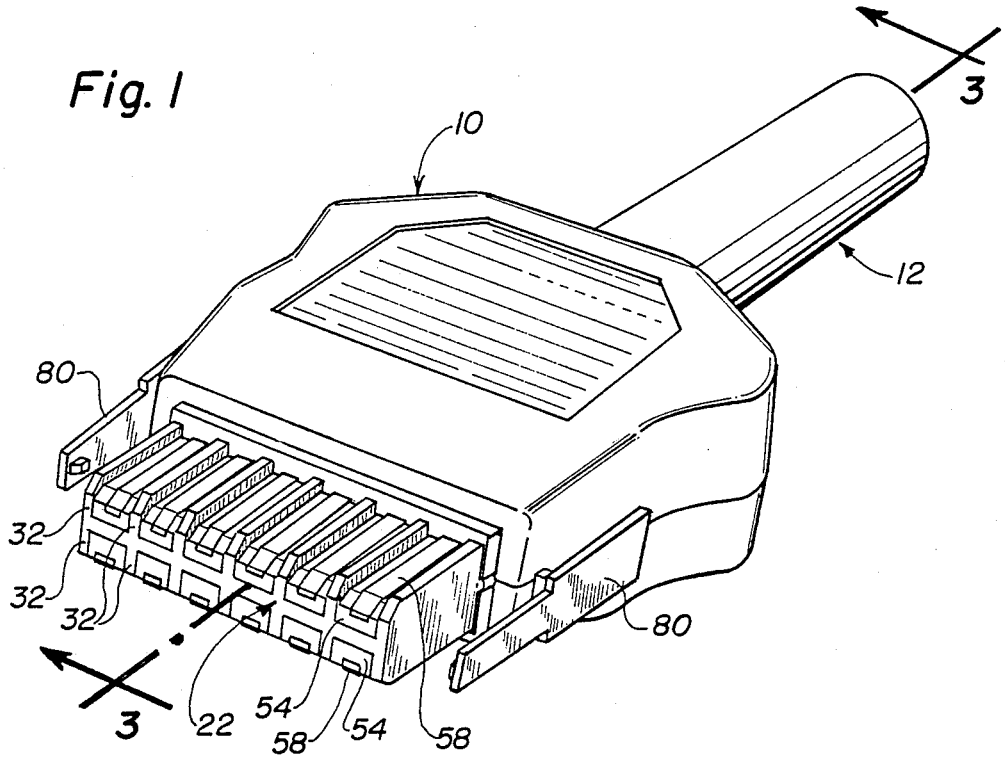
FIG. 1 is a perspective view of an assembled terminator in accordance with the present invention implemented as a plug terminator for a multiconductor cable.

Throughout the following detailed description similar reference numerals refer to similar elements in all figures of the drawings.

Figure 2:
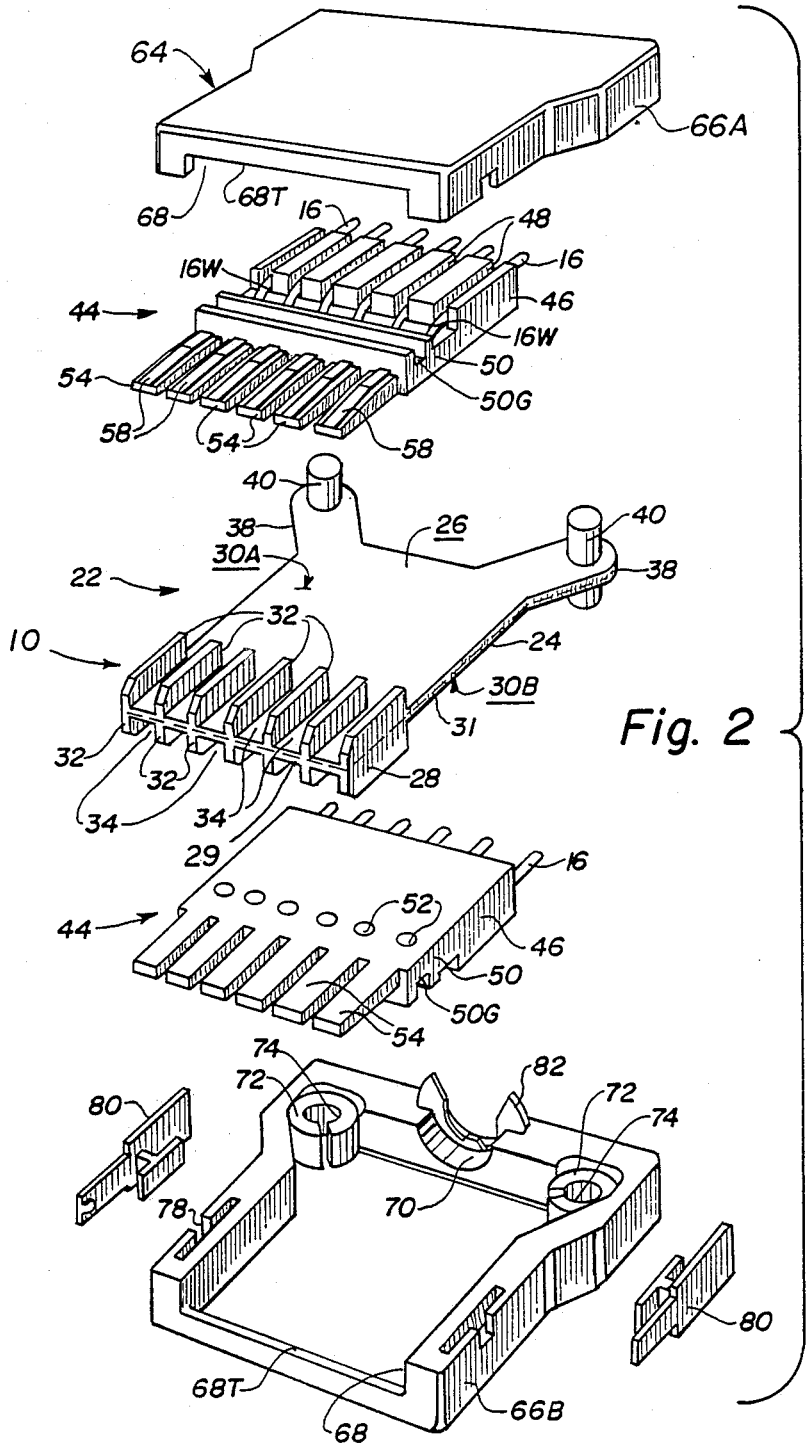
FIG. 2 is an exploded perspective view of the plug terminator shown in FIG. 1.
Figure 3:
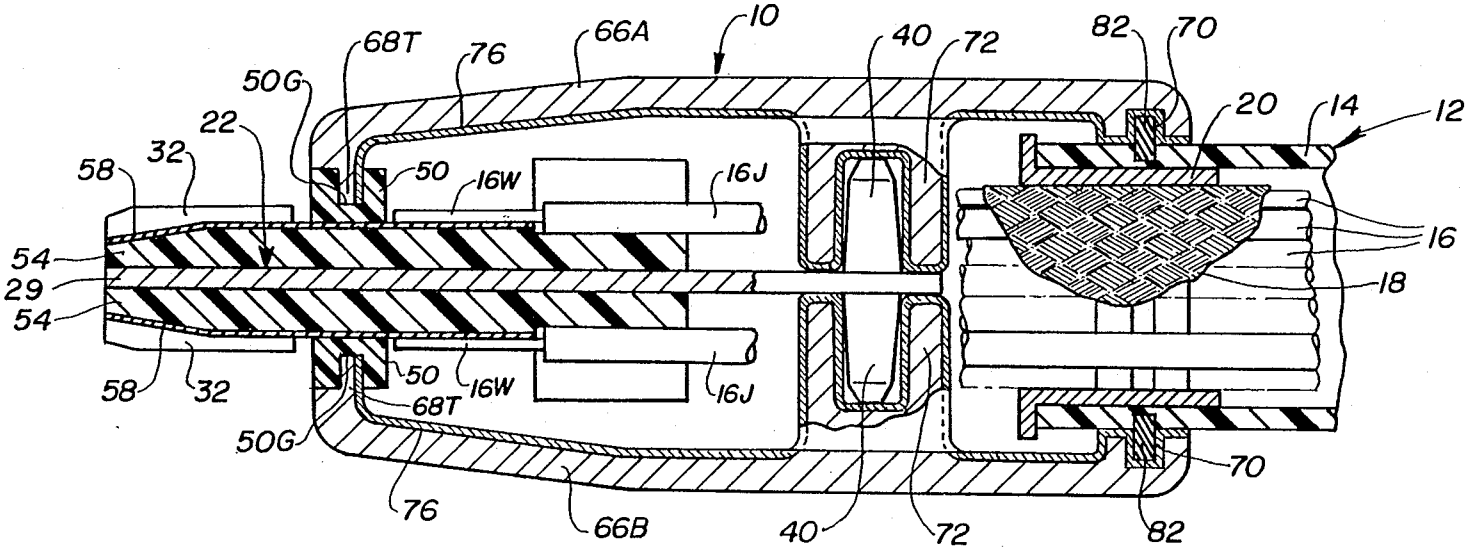
FIG. 3 is a side elevational view taken along section lines 3—3 of the plug terminator of FIGS. 1 and 2.
Figure 6:
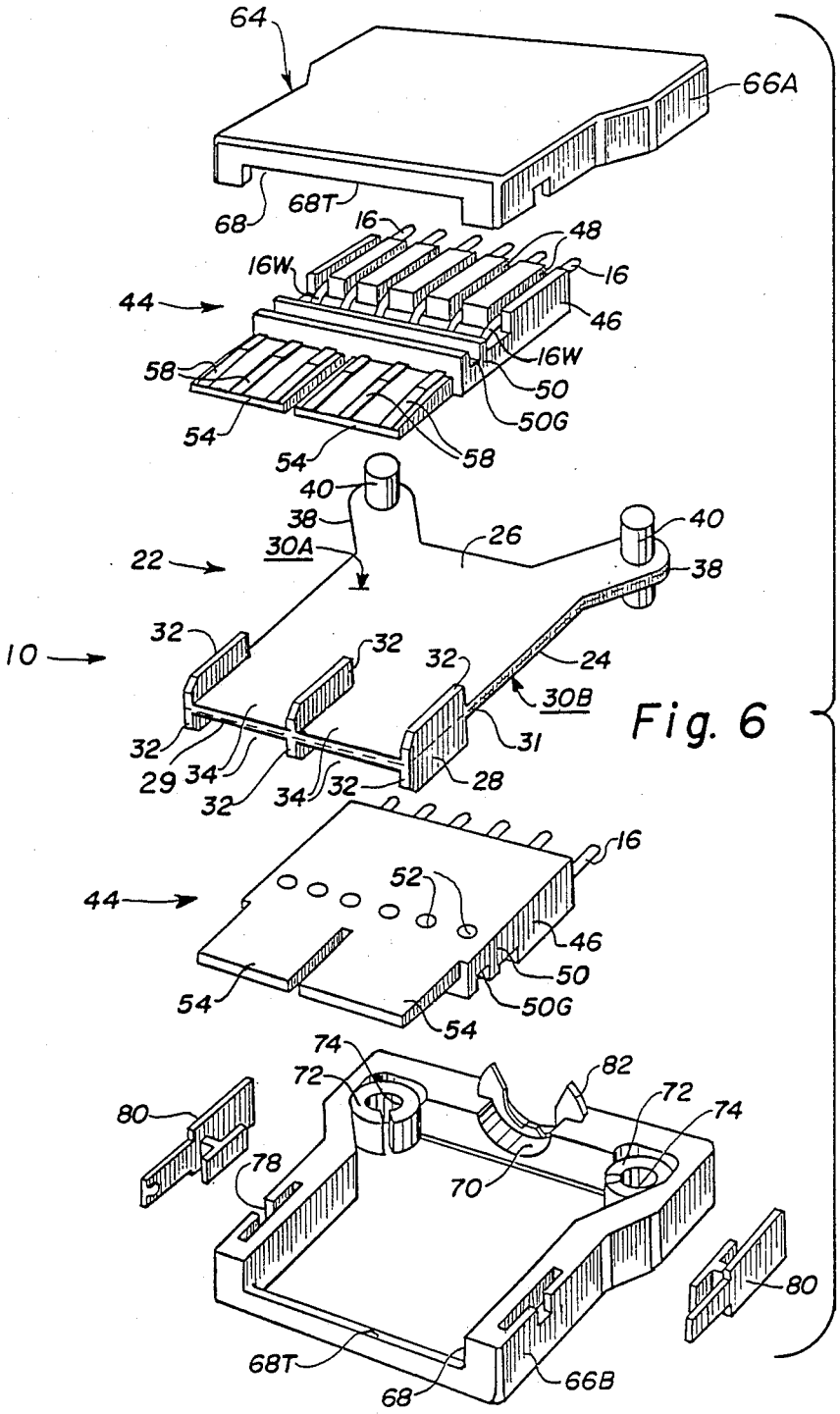
FIG. 6 is an exploded perspective view of a plug terminator for a multiconductor cable generally similar to FIG. 2, in which plural electrical contacts are provided on each of the fingers.
Figure 7:
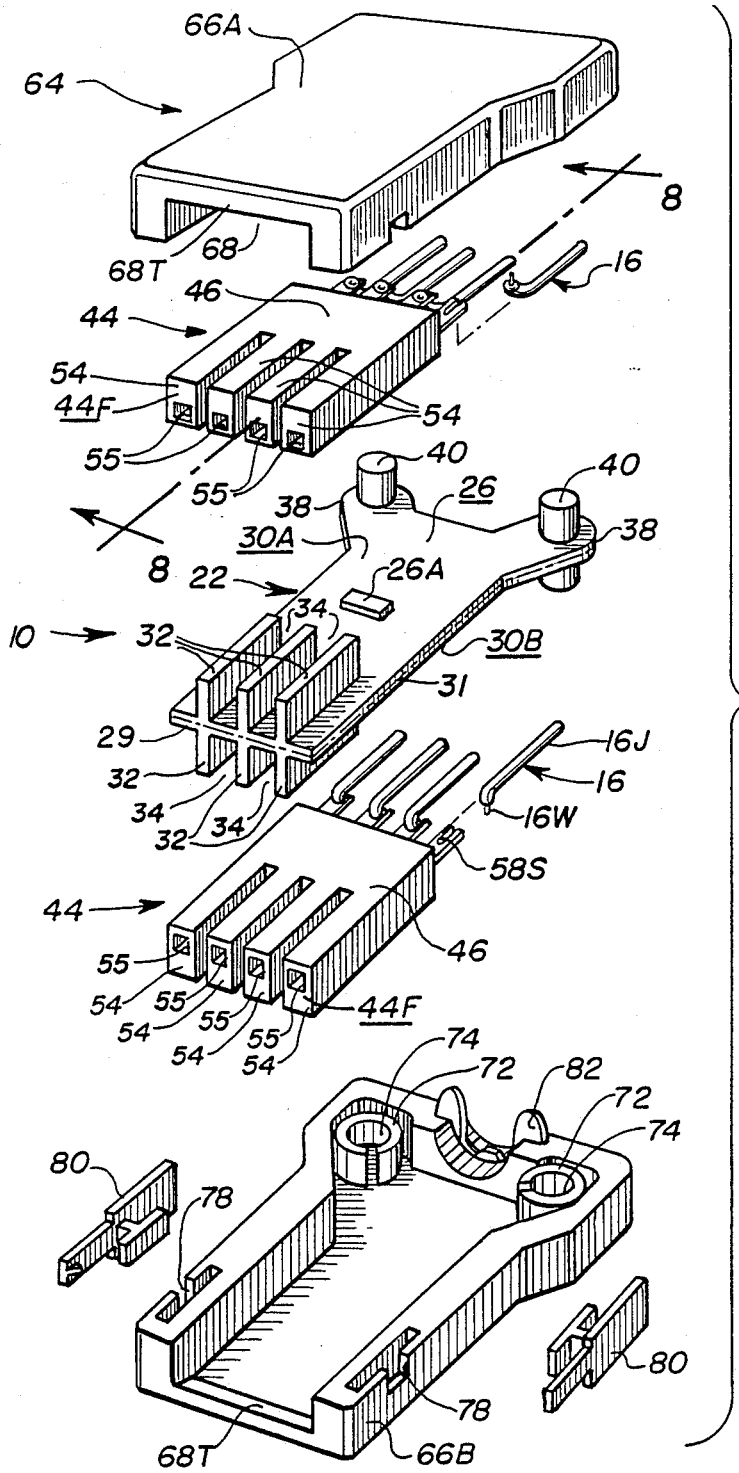
FIG. 7 is an exploded perspective view of a plug terminator similar to that shown in FIG. 2 in which each of the fingers has a recess formed therein.
Figure 8:
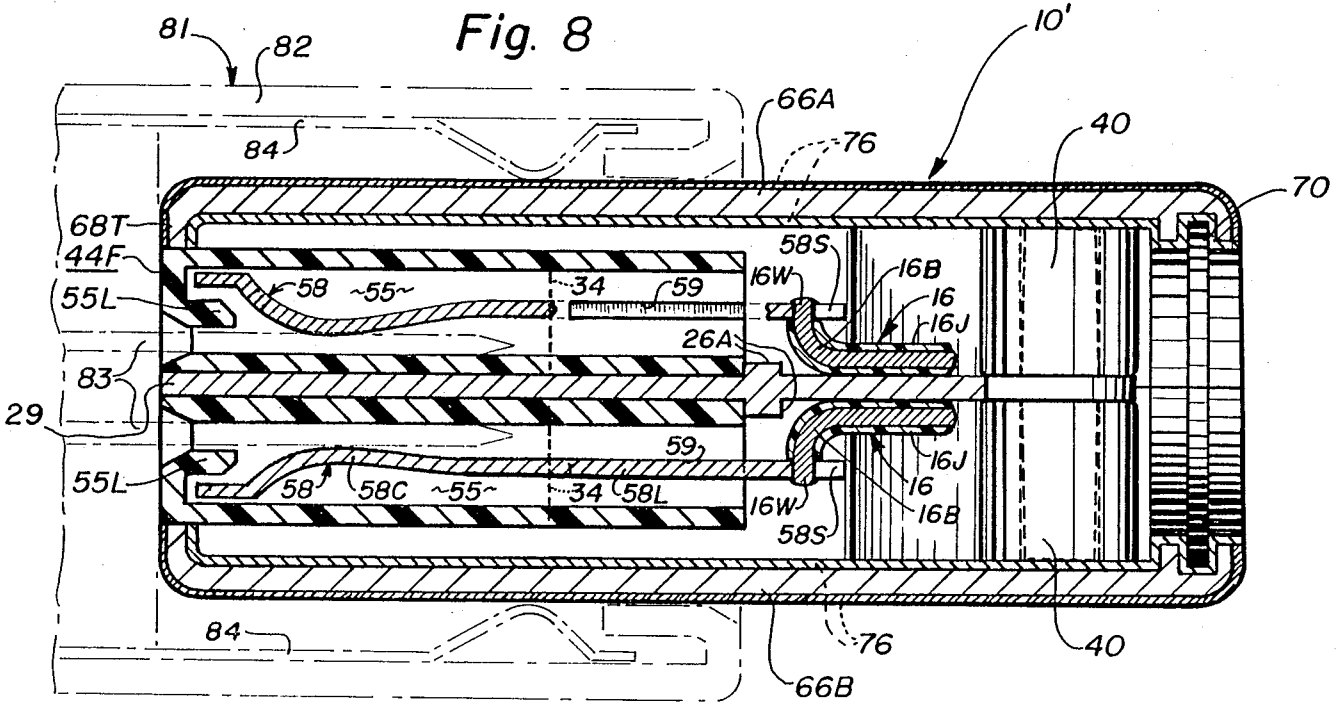
FIG. 8 is a side elevational view in vertical section taken along section lines 7—7 in FIG. 10 to include the central axis of a finger of the insulated support structure of the plug terminator and also to illustrate a receptacle adapted to receive the terminator of the type shown in FIGS. 7 and 9.
Figure 9:
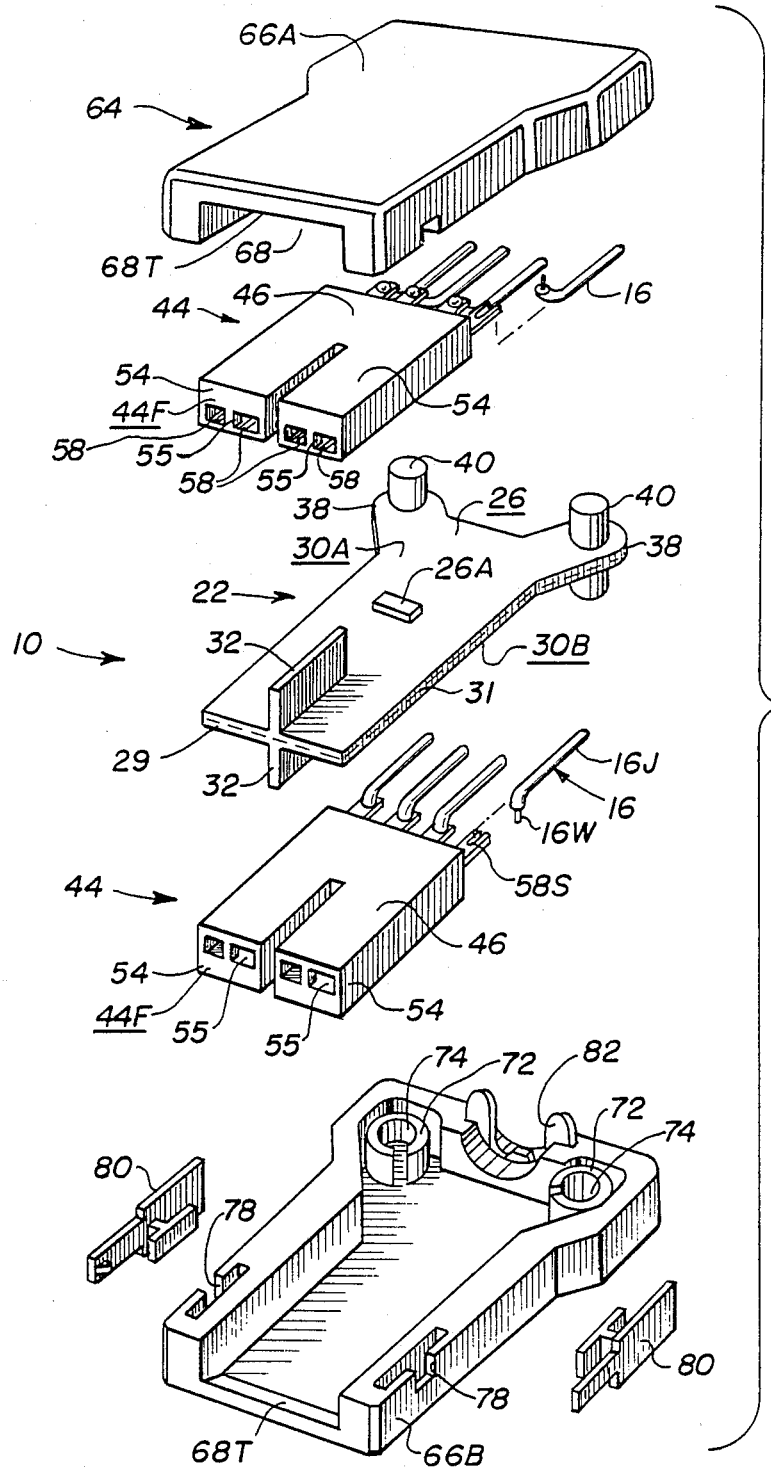
FIG. 9 is an exploded perspective view of a plug terminator of the finger having the recess therein similar to that shown in FIG. 7 in which a group of electrical contact elements are provided on each of the fingers.

With reference to FIGS. 1 to 3 shown is a terminator generally indicated by reference character 10 in accordance with the present invention implemented in the form of a plug terminator for a multiple conductor cable 12. Shown in FIGS. 7 and 8 is an alternate embodiment of a plug terminator 10 for a mulitple conductor cable in which the fingers have a hollow recess therein. FIG. 6 and FIG. 9 respectively illustrate modifications to the embodiments shown in FIGS. 1–3 and FIGS. 7–8. Although the cable 12 is shown in the Figures as being a round transmission cable it lies within the contemplation of the present invention that the plug terminator as disclosed herein may be used with equal efficacy in conjunction with a flat cable (either ribbon cable or discrete wire cable).

The cable 12 includes an outer jacket 14 (FIG. 3) of an insulating material surrounding a plurality of individual jacketed conductors 16. Each conductor 16 itself includes an insulating jacket 16J surrounding a wire conductor 16W. A conducting sheath 18 disposed under the outer jacket 14 of the cable 12 serves as a portion of the grounding and shielding structure for the cable 12. The sheath 18 is terminated by a metallic ferrule 20, such as that disclosed in U.S. Pat. No. 4,416,501, assigned to the assignee of the present invention, as is appreciated by those skilled in the art.

As is best seen in FIGS. 2 and 3 the heart of the plug terminator 10 is a metallic ground structure 22. The ground structure 22 includes a baseplate 24 having a main planar surface 26 with an integral portion 28 projecting forwardly therefrom. The projecting portion 28 terminates in a generally planar forward edge surface 29. Although the ground structure 22 is shown as being provided with an upper and a lower working surface 30A and 30B respectively thereon, it should be understood that a ground structure 22 having only one working surface 30 may be used and remain within the contemplation of the present invention. More specifically, the terminator can be implemented with a ground structure that includes only the structure on the upper working surface 30A of the ground structure 22 (that is, the structure above the dividing plane 31 extending through the baseplate portion 24 of the ground structure 22). In such an instance the opposite surface of the ground structure 22 would preferably be planar. Moreover, the remaining elements of the terminator as hereafter described would be appropriately modified to accept a ground structure 22 of this form.

A plurality of walls 32 extends from the forward projecting portion of the respective upper and lower working surfaces 30A, 30B, respectively, of the baseplate 24. The walls 32 are arranged in side-by-side relationship to define a plurality of channels 34 across the surfaces of the projecting portion 28 of the baseplate 24. As seen in FIG. 9 at least one wall, defining at least two such channels may be used in appropriate circumstances. In the preferred embodiment the axes of the adjacent channels 34 are parallel to each other, although it is understood that such a relationship is not mandated. It should also be understood that although each working surface 30A, 30B of the baseplate 24 is shown as having the same number of channels 34, such a situation is also not necessarily required. It should also be appreciated that the walls 32 at the lateral extremities of the ground structure 22 may be omitted if desired (e.g., FIGS. 7, 9).

The planar portion 26 of the baseplate 24 behind the projecting portion 28 has flanges 38 which flare farther rearwardly and slightly outwardly from the baseplate 24. The flanges 38 carry posts 40. In some instances it may be desired that the posts 40 be electrically conductive and in electrical contact with the conductive material of the baseplate 14. It should be appreciated that a ground structure of more than two working surfaces may be defined by disposing additional baseplates 24 (whether each baseplate implemented with one or two working surfaces) in any convenient stacked relation.

In the Figures the ground structure 22 is shown as being fabricated as an integral metallic member, although it should be understood that any suitable construction for the ground structure 22 may be used. For example, the ground structure 22 can be formed from plastic with its entire upper and lower working surfaces 30A, 30B (including the walls 32 on the projecting portions 28) lined with a suitable conductive material. Alternately, the baseplate 24 may be formed or stamped from a sheet of conductive material with slots provided near the forward end thereof. The end walls 32 may be formed from similar slotted stampings. The baseplate 24 and the walls 32 are joined via the slots to define the ground structure 22 as shown in the Figures.

The plug terminator 10 further comprises a contact support member 44 having a main body portion 46 with an array of trenches 48 formed therein. The contact support member 44 is formed of an insulating material. A partition 50 having an indentation 50G is provided near the forward end of the body portion 46 of the contact support member 44. An array of apertures 52 (visible on the lower member 44 in FIG. 2) is provided through the body 46 of the support member 44 in the region behind the partition 50, with one of the apertures 52 being aligned with the mouth of each of the grooves 48 for a purpose to be described. An array of fingers 54 extends forwardly from the body 46. The fingers 54 correspond in number to the number of channels 34 provided on the ground structure 22. In the assembled condition the fingers 54 extend into the channels 34 so that the forward ends of the fingers 54 are coterminal with the forward edge 29 of the ground structure 22.

An array of electrical contacts elements 58 of any suitable configuration are embedded in the insulating material of the fingers 54. The contact elements 58 are arranged such that the planar blade of each contact element 58 is exposed on the surface of the finger 54 in which it is disposed. The contact element 58 extends rearwardly from the fingers 54 through the material of the partition 50. The contact element 58 ends in an overlying relationship with the apertures 52 in the body 46 just forwardly of the mouths of the trenches 48 therein. As seen in the Figures the top surfaces of the walls 32 of the ground structure 22 extend above the contact elements 58 when the same are received in the channels 34.

The plug terminator 10 may be modified as shown in FIG. 6 to carry groups of contacts 58 as opposed to the individual contact elements carried by the fingers 54 shown in FIGS. 1 to 3. In the modification shown in FIG. 6 the fingers 54 exhibit a greater lateral dimension measured in a plane parallel to the dividing plane 31 than the dimension of the fingers 54 of FIG. 3. Each of the laterally enlarged fingers carries a group of contact elements 54. Each group of contact elements may contain any predetermined number (two or more) of the contacts. It should be appreciated that each group of contacts need not contain the same number of contacts as contained in a group disposed on an adjacent enlarged finger. It should also be realized that any predetermined number of enlarged fingers 54 may be provided, although in FIG. 6 only two of such enlarged fingers 54 are illustrated. The ground structure 22 contains a number of channels 34 corresponding to the number of enlarged fingers 54.

The terminator 10 includes a protective casing generally indicated by reference character 64. The casing 64 is defined by complementary shell members 66A, 66B. Each shell member 66A, 66B has a forward cutout 68 having a tongue 68T therein. The configuration of the cutout 68 corresponds to the configuration of the body portion 46 of the contact support member in the vicinity of the partition 50. The rear wall of each of the shell members 66A, 66B has cooperating grooved openings 70 therein. The openings 70 are shaped to generally conform to the exterior configuration of and are sized to closely accept the transmission cable 12 in either round or flat form.

Adjacent to the rear wall of th shells 66A, 66B is a pair of abutments 72 with recesses 74. The recesses 74 are configured to accept snugly the posts 40 on the ground structure 22 in a press fit relationship. In the preferred case the shells 66A, 66B are each fabricated of a conductive material. It should be understood that the shells may be fabricated from a plastic material in which case a conductive surface 76 is formed by a suitable conductor layer disposed on the inner surface of each of the shells 66A, 66B (as shown in FIG. 3 for economy of illustration). The sidewalls of the shells 66A, 66B each carry notches 78 sized to accept locking tabs 80 which serve to hold the casing 64 together.

In the assembled condition shown in FIGS. 1 through 3 and in FIG. 6 the complementary shells 66A and 66B close on each other and are locked together by the tabs 80 and the press fit engagement of the posts 40 in the recesses 74 in the abutments 72. When so assembled the tongue 68T near the cutout 68 adjacent the front of the casing 64 engages in the groove 50G. The multiple conductor cable 12 extends through the registered openings 70 in the rear of the shells 66A, 66B and into the volume defined in the rear of the casing 64. The external jacket 14 of the cable 12 is stripped a predetermined distance from its end to expose the individual jacketed conductors 16 therein. An insulating displacement contact 82 severs the exterior jacket 14 of the cable 12 and electrically interconnects with the ferrule 20 of the cable 12. The insulation displacement contact 82 is captured in the grooved openings 70 adjacent the rear aperture of the shell to thereby electrically interconnect the conductive surface 76 on the interior of the casing 64 to a predetermined electrical potential.

Prior to the closing of the casing by the interengagement of the shells 66A, 66B, the individual conductors 16 of the cable 12 are themselves stripped of their jackets 16J and the conductive wires 16W thereof laid in one of the trenches 48 extending in the body portion 46 of the contact support structure 44. The end of each of the wires 16W overlays the end of one of the contact elements 58. The wires 16W and the contacts 58 may be suitably attached, as by welding, solder or insulation displacement contacts to interconnect the wires 16W to the contacts 58 and remain within the contemplation of the present invention.

FIGS. 7 and 8 illustrate an alternate embodiment of the cable plug terminator form 10 of the invention generally similar to the embodiment of the invention shown in FIGS. 1 to 3 and in FIG. 6. In the alternate embodiment of the invention shown in FIGS. 7 and 8 the contact support member 44 is provided with a main body portion 46, formed of an insulating material, from which a plurality of fingers 54 extend. The fingers 54 each include a recess 55 having a lip 55L (FIG. 8) provided therein. Each finger 54 is, therefore, a substantially hollow member in which a spring electrical contact element 58 is received. The tail portion of the contact 58 is provided with a slot 58S that imparts to the tail portion of the contact 58 a configuration generally similar to that of an insulation displacement contact. The head or forward end of the contact 58 is captured by the lip 55L while the tail end of the contact 58 projects rearwardly from the main body portion 46 of the member 44. The generally linear portion 58L of the contact 58 between the curved electrical engaging region 58C and the slotted tail 58S is captured at each lateral horizontal edge of the contact 58 in a groove 59 formed in each of the sidewalls of the main portion of the support member 44. In FIG. 8 a portion of the contact 58 is cut away to clearly illustrate the groove 58.

The member 44 is mounted to the ground structure 22 in a manner generally similar to the arrangement formed and shown in connection with FIGS. 2 and 3. The fingers 54 of the member 44 are each received in one of the channels 34 defined by the walls 32 of the ground structure 22. The member 44 is positioned on the structure 22 by the engagement of the main portion 46 of the member 44 with the inner ends of the walls 34 of the structure, as is illustrated in the FIG. 8. The member 44 is held in the position shown in drawing FIG. 8 by an abutment 26A formed on the planar portion 26 of the baseplate 24 of the structure 22. Of course, any suitable expedient may be used to position a member 44 on one (or both) surface(s) of the structure 22 The welding apertures 52 (perhaps best seen in FIG. 2) provided in the planar portion 26 of the structure 22 are eliminated inasmuch as the welded attachment of the conductor wires 16W to the tail portion of the contact 58 may be effected, for example, by a facial welding process disclosed and claimed in U.S. Pat. No. 4,774,394, assigned to the assignee of the present invention. To this end the wires 16W of the conductors 16 are bent, as at 16B (FIG. 8), to cause the axis of the portion of the wire 16W immediately rearwardly to the facial end of the wire 16W to extend linearly through the tail end portion of the contact 58.

The protective casing 64 of the terminator 10 is also slightly modified from that shown in FIGS. 2 and 3 and FIG. 6 in that the shell portions 66A, 66B extend forwardly and turn downwardly and upwardly, respectively, to define the tongue portion 68T such that the forward edge of the casing is coextensive with the forward face 44F of the contact support member 44. The shell members 66A and 66B are held together in the same manner as that described for the arrangement of the connector shown in FIGS. 2 and 3. That is, the posts 40 on the ground structure 22 are press-fit into recesses 74 in the abutments 72 in the shells 66A, 66B. The sidewalls of the shells 66A, 66B are notched, as at 78, to accept locking tabs 80. As is the case in the embodiment of the invention shown in FIGS. 2 and 3 the casing 64 shown in FIGS. 7 and 8 may be fabricated entirely of a conductive material. However, as is also earlier noted, the shells 66A, 66B can be fabricated of a nonconductive material, e.g., plastic, in which event conductive layers 76 should be provided on both the interior and exterior surfaces thereof. The layers 76 are illustrated in the Figures for economy of illustration.

The embodiment of the plug terminator 10 shown in FIGS. 7 and 8 may be modified to carry a group of contact elements 58. In the modification shown in FIG. 9 the hollow fingers 54 exhibit a greater lateral dimension measured in a plane parallel to the dividing plane 31 than the dimension of the fingers 54 of FIG. 7. Each of the laterally enlarged fingers 54 carries a group of contact elements 54. Each group of contact elements may contain any predetermined number (two or more)

of the contacts. It should be realized that, similar to the modification of the embodiment of FIG. 2, any predetermined number of enlarged fingers 54 may be provided, although in FIG. 9 only two of such enlarged hollow fingers 54 are illustrated. The ground structure 22 contains a number of channels 34 corresponding to the number of enlarged fingers 54. Moreover, it should be appreciated that each group of contact need not contain the same number of contacts as contained in a group disposed on an adjacent enlarged finger.

Figure 12:
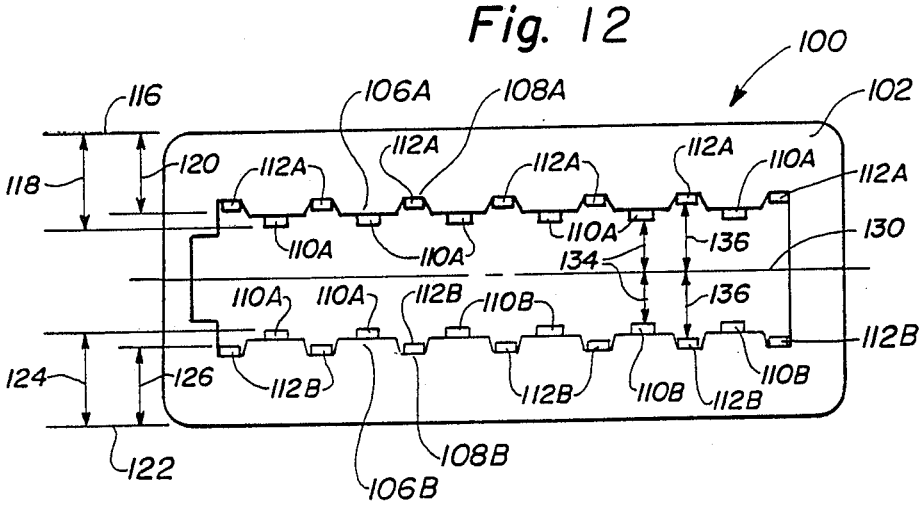
FIG. 12 is a front elevation view of the receptacle of FIG. 10.

In all other respects the embodiment of the invention shown in FIGS. 7–8, and in FIG. 9 is identical to that disclosed in connection with FIGS. 2, 3, and FIG. 12. Accordingly the remaining reference characters used in FIGS. 8 and 8 and in FIG. 9 correspond to those used in FIGS. 2, 3, and 6 to identify corresponding parts. It is noted that throughout this application no significance should be attached to differences in the number of walls 32, channels 34, fingers 54, etc., used in depicting the various embodiments and modifications of the various forms of the invention.

As is seen in FIG. 8 the terminator 10 shown in FIGS. 7–8 and in FIG. 9 is received within a receptacle in the form of a mating header 81. The header is generally similar to that shown in U.S. Pat. No. 4,601,527 (Lemke), assigned to the assignee of the present invention. The header 81 includes an insulating housing 82 having an array of pins 83 extending therefrom. Each pin 83 is respectively received within one of the recesses 55 in the fingers 54. Each pin 83 is in electrical engagement with the electrical engaging region 58C of the contact 58. The housing 82 also contains spring contacts 84 which engage the metallic shells 66A, 66B (or the layer 76 disposed thereon in the event the shells 66A, 66B are formed of insulating material) thereby to establish a grounded interconnection with the shells 66A, 66B.

Figure 4:
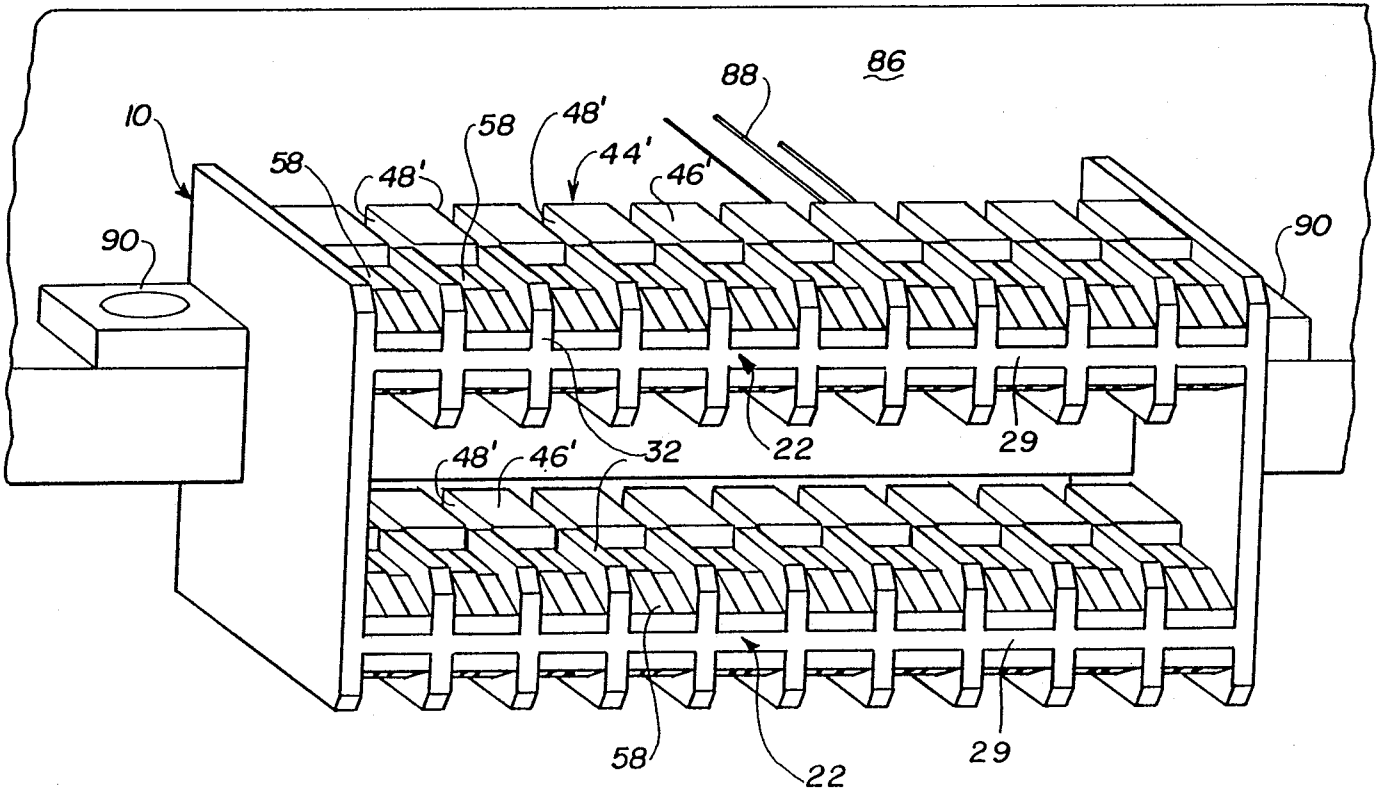
FIG. 4 is a front perspective view of a terminator in accordance with the present invention implemented in the form of an edge card terminator.
Figure 5:
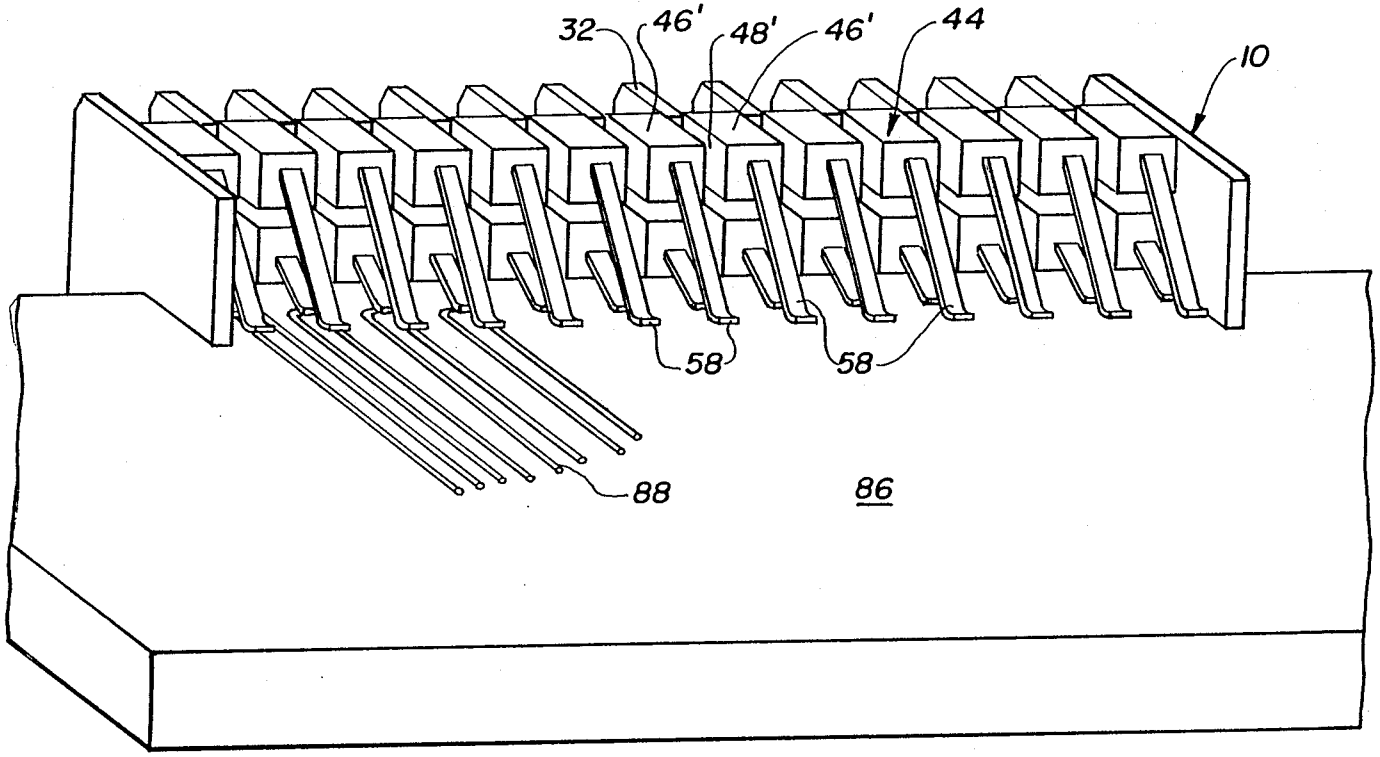
FIG. 5 is a back view of the edge card terminator of FIG. 4.

As may be seen by reference to FIGS. 4 and 5, a terminator 10 in accordance with the present invention may be used in the environment of an edge card terminator for substrates such as a printed circuit board 86 having multiple conductive tracings 88 thereon. In the instance shown in FIGS. 4 and 5 a ground structure 22 similar to that described in connection with FIGS. 1–3 is disposed both above and below the board 86. To facilitate this mounting arrangement the ground structures 22 are supported at their ends by a bracket 90. Each of the structures 22 receives a contact support member 44' generally similar to that discussed in connection with FIGS. 1 through 3 with the exception that the body portion 46' thereof is truncated. As seen in FIGS. 5, the contact elements 58 emanating from the support member 46' are directed joined to the conductive tracings 88 on the surfaces of the board 86. It should be appreciated that the terminator may be used to service only one of the surfaces of the board 86. It should be understood that the edge card form of the terminator shown in FIGS. 4 and 5 may be modified to conform to that shown in FIG. 6 in which each of the fingers of the contact support member 44' is provided with plural contact elements.

Alternatively, the terminator of FIGS. 4 and 5 may be implemented using the finger having the hollow recess therein, as is depicted in FIG. 7 (single contact element in the recess) or in FIG. 9 (plural contact elements in each recess). Of course the ground structure 22 is appropriately modified to conform in each case.

In practice the ground structure 22 used in connection with any of the above discussed FIGS. 1 through 9 is connectable to a predetermined electrical potential (e.g., chassis or logic ground). Since the walls 32 near the forward projecting portions 28 of the baseplate 24 extend above the signal carrying contacts 58 generally U-shaped receptacles are formed in which the signal carrying contacts 58 are disposed. The ground structure 22 thus electrically shields and isolates each signal carrying contact 58 or group of contacts 58 from each adjacent signal carrying contact or group, as the case may be, whether these contacts are sidewise and/or vertically adjacent. It is noted in the cases where a group of contacts are provided on each finger (as in FIG. 6 and in FIG. 9) the effect of the ground structure is to provide a ground plane to the contact group resulting in impedance control and lowered cross-talk. This would be analogous to a "microstrip" in printed circuit technology.

Figure 10:
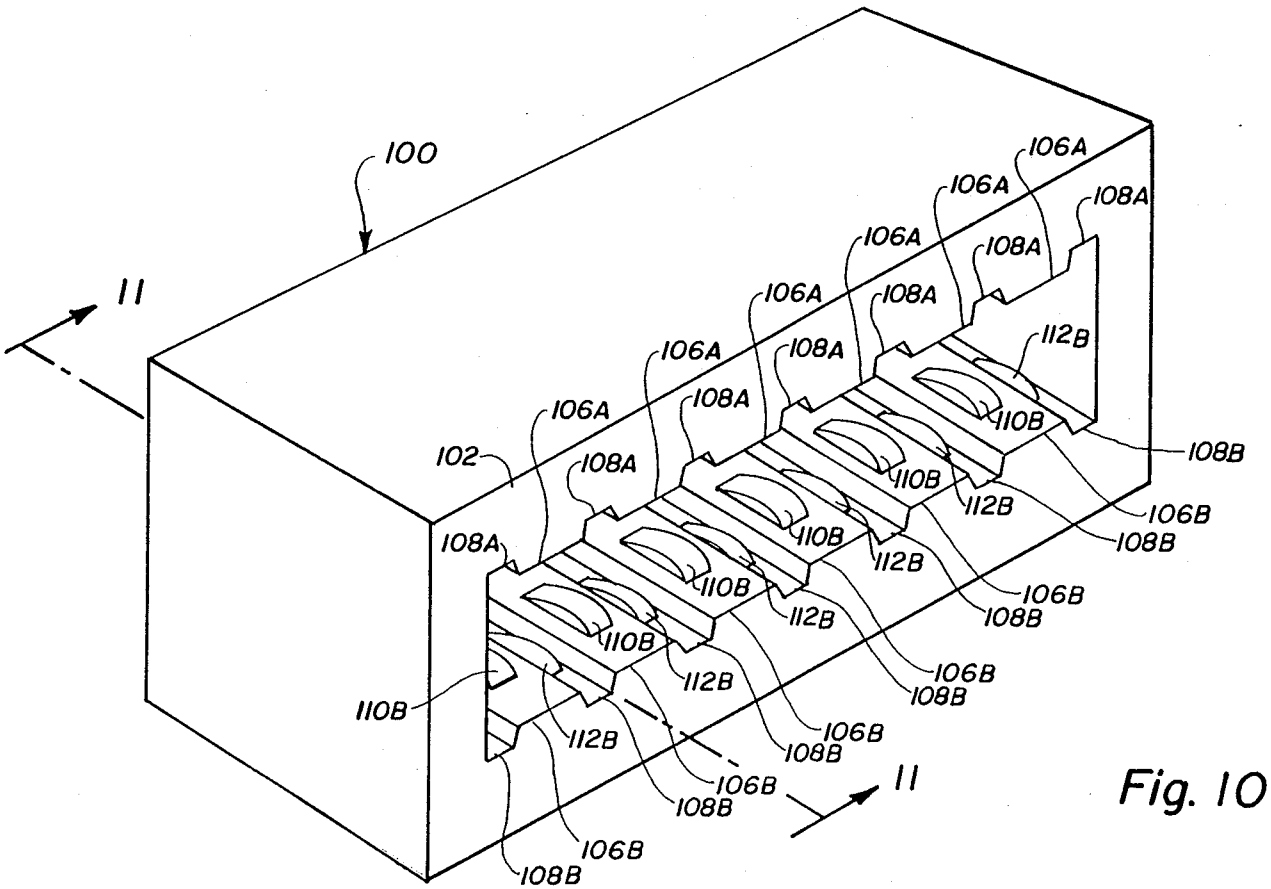
FIG. 10 is a perspective view of a receptacle adapted to accept a terminator in accordance with the present invention whether the terminator is implemented in either the cable plug form or the edge card form as shown in FIGS. 2, 4, adn 6.
Figure 11:
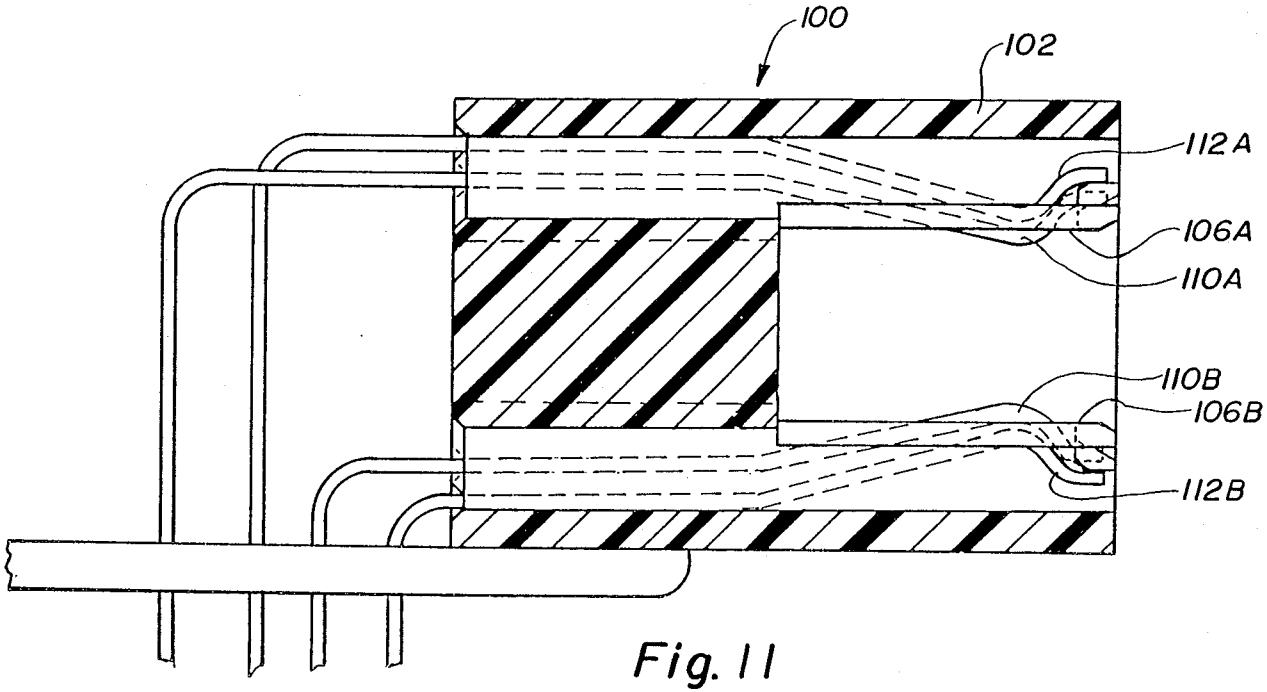
FIG. 11 is a side view entirely in section of the receptacle of FIG. 10.

With reference to FIGS. 10 through 12 shown are perspective, sectional, and elevational views of a receptacle assembly 100 adapted to accept a plug terminator 10 as described heretofore in connection with FIGS. 1–6. A receptacle useful for a terminator having hollow fingers (FIGS. 7–9) has been described earlier in connection with FIG. 8. Also the receptacle shown in FIGS. 14 to 19 may be used with the terminator having hollow fingers as will be discussed.

The receptacle 100 includes a main body portion 102 fabricated of a suitable insulating material such as molded plastic. The body 102 has a main opening that receives the terminator 10 therewithin. The housing is generally similar to that described in U.S. Pat. No. 4,601,527, assigned to the assignee of the present invention.

However, in accordance with the present invention the upper and lower edges of the receptacle body 102 are provided with an alternating array of lands 106A, 106B and grooves 108A, 108B, respectively. The surfaces of the lands 106A, 106B and the troughs of the grooves 108A, 108B are provided with suitable electrical contacts 110A, 110B and 112A, 112B respectively. The contacts are retained in the receptacle 100 in the standard manner.

As may be seen in FIG. 12, in accordance with the present invention the contacts 110 and 112 are supported in the body 102 of the receptacle 100 such that, as measured with respect to a predetermined datum, the contacts 110 disposed on the lands 106 extend for a distance from the datum different than the distance that the contacts 112 extend from the datum. With reference to the upper array of lands 106A and grooves 108A, the reference datum is selected at the plane 116 containing the upper surface of the housing 102. As so defined it may be appreciated that the contacts 110A on the lands 106A extend for a distance 118 from the datum 116 that is greater than the distance 120 that the contacts 112A in the grooves 108A extend from the datum 116. A similar situation is extant with respect to the contacts 110B and 112B respectively provided in the lands 106B and the grooves 108B on the lower array. In the latter instance the reference datum is selected to be the plane 122 containing the lower surface of the housing 102 and the distances defined between the contacts 110A is indicated by the character 124 and the distance defined by the contacts 112B is indicated by the character 126.

In the context of the dual array receptacle as shown in the FIGS. 10 through 12, an equally useful datum may be defined by a bisecting plane 130 (FIG. 12) extending parallel to the arrays of contacts and midway therebetween. In this event the contacts 110A, 110B on the lands 106A, 106B respectively are spaced a distance 134 from the datum 130 while the contacts 112A, 112B in the grooves 108A, 108B, respectively are spaced from the datum 130 by the distance 136.

As a result of the staggered structural relationship of the contacts in the lands with respect to those in the grooves a terminator 10 may be received in the receptacle 100 such that the upper surfaces of the walls 32 on the ground structure 22 are brought into electrically conductive engagement with the contacts in the grooves 108, while the contacts 58 supported in the contact support 44 are brought into electrically conductive engagement with the contacts 110 on the lands 106. The location of the signal and the ground connections on essentially two levels of the receptacle 100 permits the density of the connector to be increased. Since the ground connection is provided by the walls of the structure 22, the width dimension of the walls could be physically less than the width dimension of the signal carrying contact blades. This situation permits an increase in signal density while maintaining transmission line characteristics. Moreover the staggering of the signal and ground interconnection points on two levels permits further compression of the structure leading to yet greater density.

Finally, since isolation is provided by the ground structure 22 and not by individual ones of the contacts, all of the blades can be used to carry signals, thus further enhancing the density of the connector.

Figure 13:
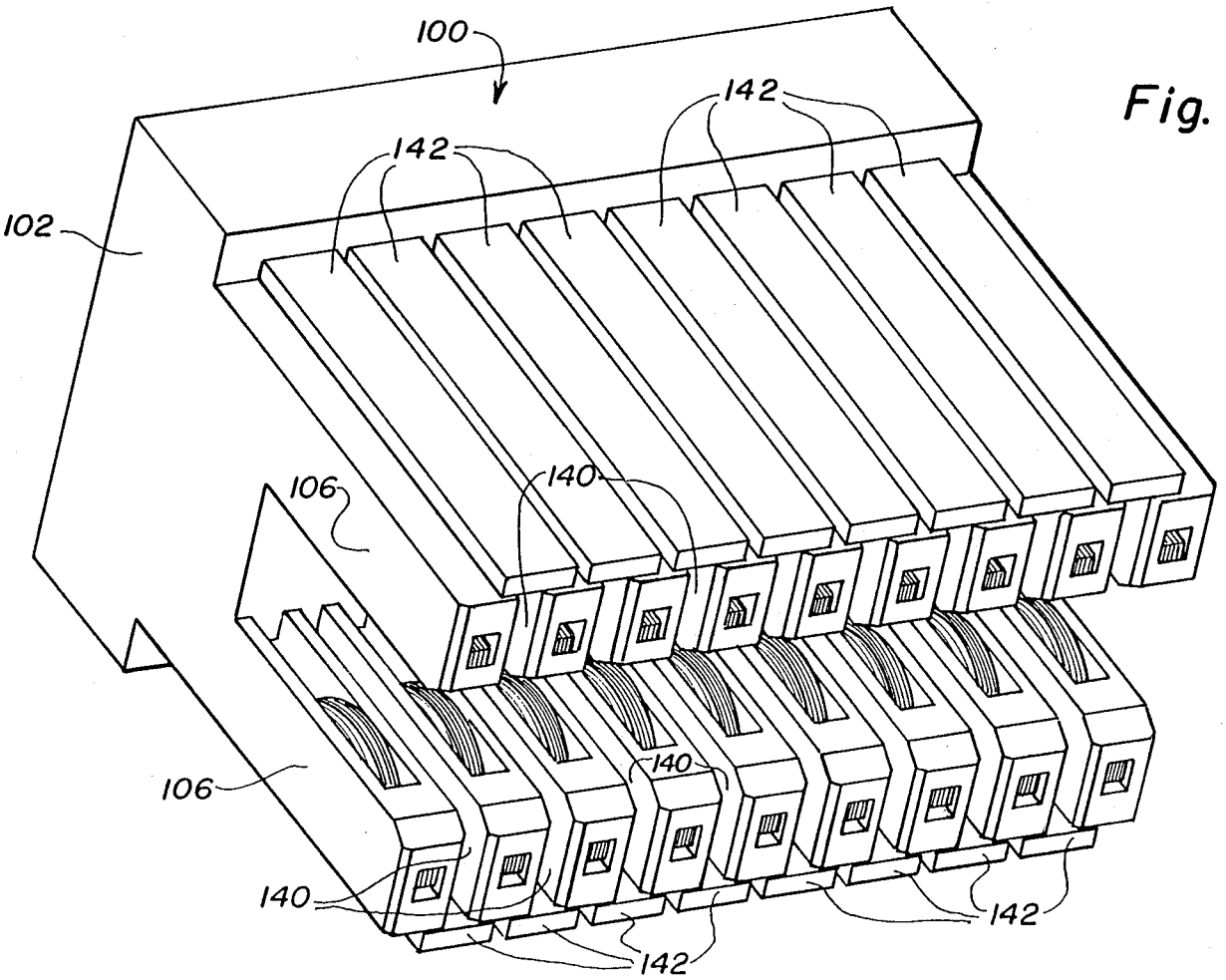
FIG. 13 is a perspective view similar to FIG. 10 showing an alternate embodiment of a receptacle adapted to receive the terminator of the present invention whether the terminator is implemented in either the cable plug form or the edge card form as shown in FIGS. 2, 4, and 6.

The structure of the receptacle shown in FIGS. 10 through 12 is modified slightly as shown in FIG. 13. In this embodiment the lands 106 are separated by slots 140. Instead of contacts 112 of the spring type, contact plates 142 are provided that overlie a portion of the slots 140. The ground structure 22 is slightly modified in that the walls 32 are extended to a height sufficient to permit the upper surfaces of the walls 32 to contact against the contact plates 142. It should be understood that in this embodiment (as well as the embodiment shown in FIGS. 10 through 12) the plates 142 (and the ground contacts 112) are preferably connected in common. It should be understood that although in FIGS. 10 through 13 preloaded contilevered beam contacts are illustrated the receptacle 100 (or 100') in accordance with the present invention can be implemented using any suitable alternate form of contact.

When the terminator is introduced into a corresponding receptacle of the type shown in FIGS. 10 to 13 there will exists the potential that the individual signal carrying contacts within the body of the receptacle itself may interfere electrically with each other. Accordingly FIGS. 14 through 19 illustrate an embodiment of a receptacle useful with any terminator as hereinbefore disclosed which minimizes the potential of cross-talk between contacts within the receptacle.

Figure 14:
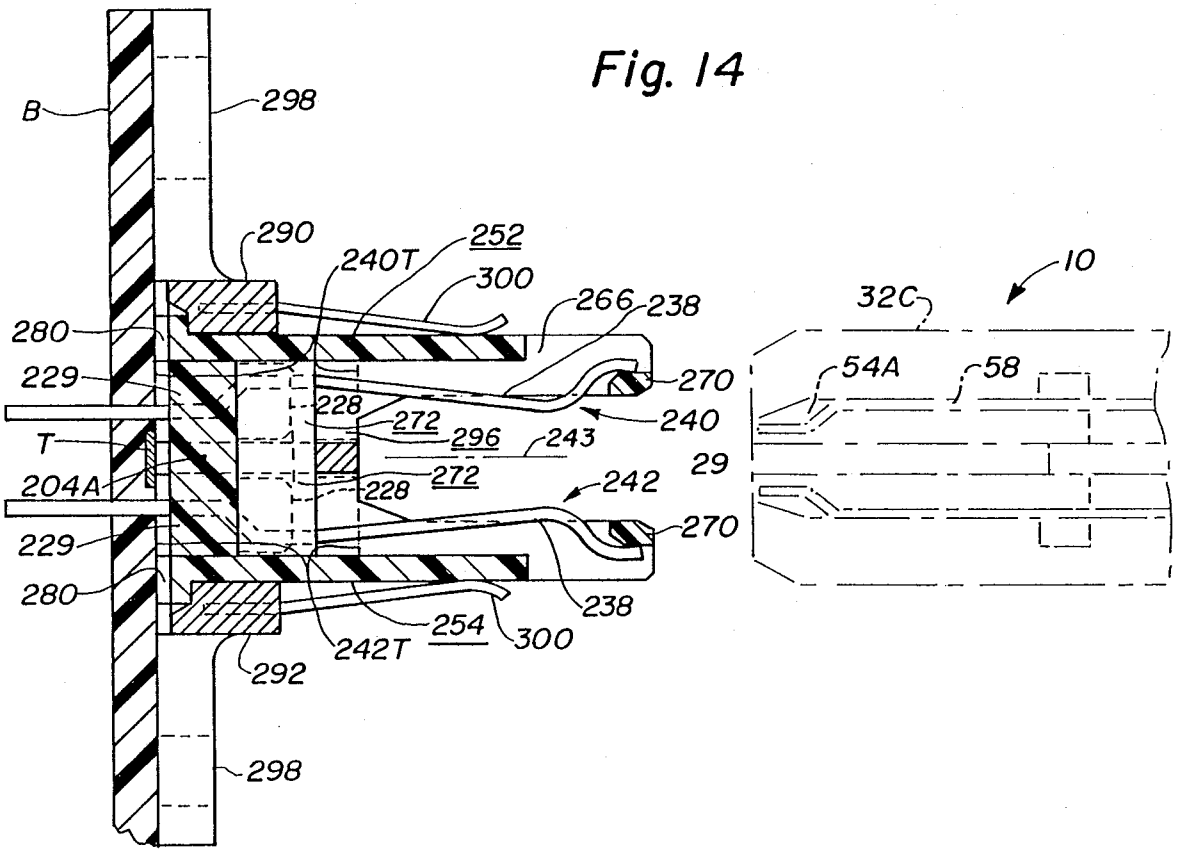
FIG. 14 is a side elevational view, entirely in section, illustrating a fully assembled receptacle in accordance with an alternate embodiment of the present invention.
Figure 15:
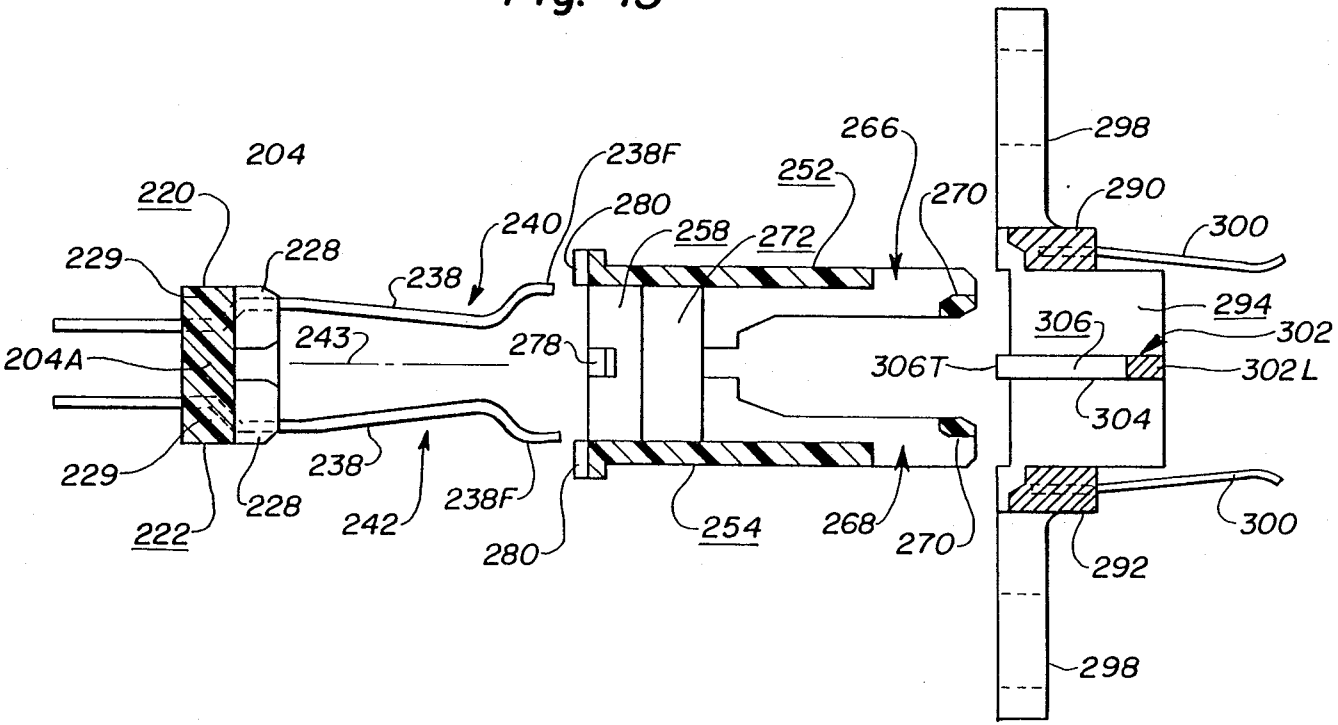
FIG. 15 is an exploded, side elevational section view of the receptacle shown in FIG. 14.
Figure 16:
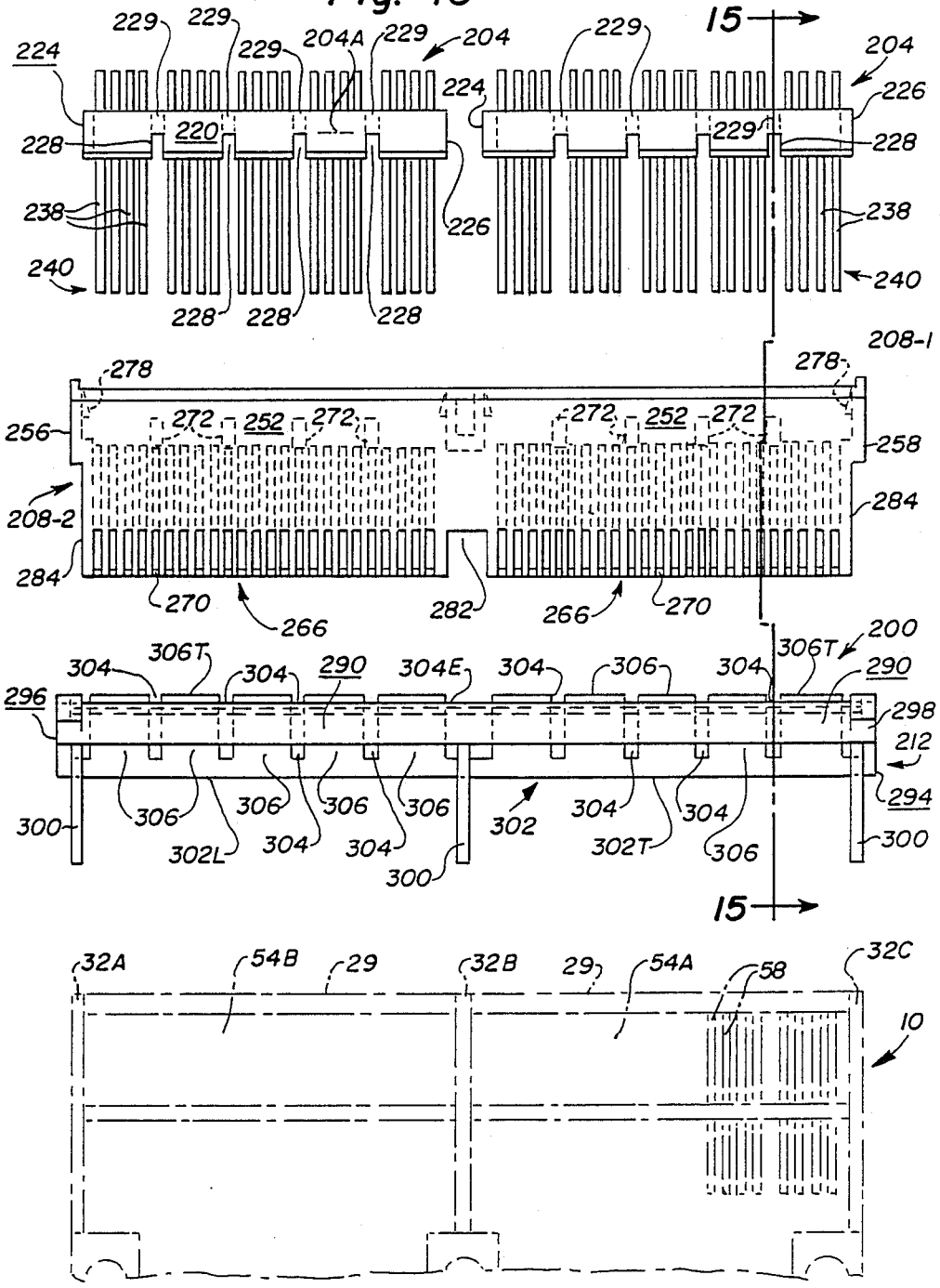
FIG. 16 is an exploded, plan view of the receptacle shown in FIG. 14.

FIG. 14 shows a side elevational view, entirely in section, of a receptacle 200 in accordance with the present invention in the fully assembled state and ready to accept a plug terminator 10 shown in phantom lines. FIGS. 15 and 16 are respectively exploded side elevation and plan views of the receptacle 200 shown assembled in FIG. 14. In the discussion that follows it is assumed that the terminator is of the type shown in FIG. 16 (generally similar to that shown in FIG. 6) having two fingers 54A, 54B. Each finger 54A, 54B is provided with a plurality of contact elements 58. As may be seen from FIG. 16, the ground structure 22 of the terminator is provided with three walls 32A, 32B and 32C whereby two channels 34A, 34B are defined. The leading edge surface of the ground structure 22 is again indicated in the FIGS. 14 and 16 by reference character 29. It should be understood that the receptacle may be modified to accept a terminator of the type in which a single contact element 58 is disposed on each finger. Of course any of the other terminator structures shown in this application may be used, if desired, with appropriate modification of the receptacle in accordance with the teachings herein.

In FIG. 14 the receptacle is shown as mounted to the surface of a board B in a vertical through mount configuration. However. it should be appreciated that the receptacle of FIG. 14 may be implemented in any other mounting configuration, such as a right angle through mount configuration, a surface mount configuration, or a straddle mount configuration. Moreover it should also be understood that any of the receptacles shown in FIGS. 10 through 13 may also be implemented using any of these mounting configurations.

The receptacle 200 includes three main structural components, namely, a contact block 204, a housing 208 and a frame 212.

Figure 17:
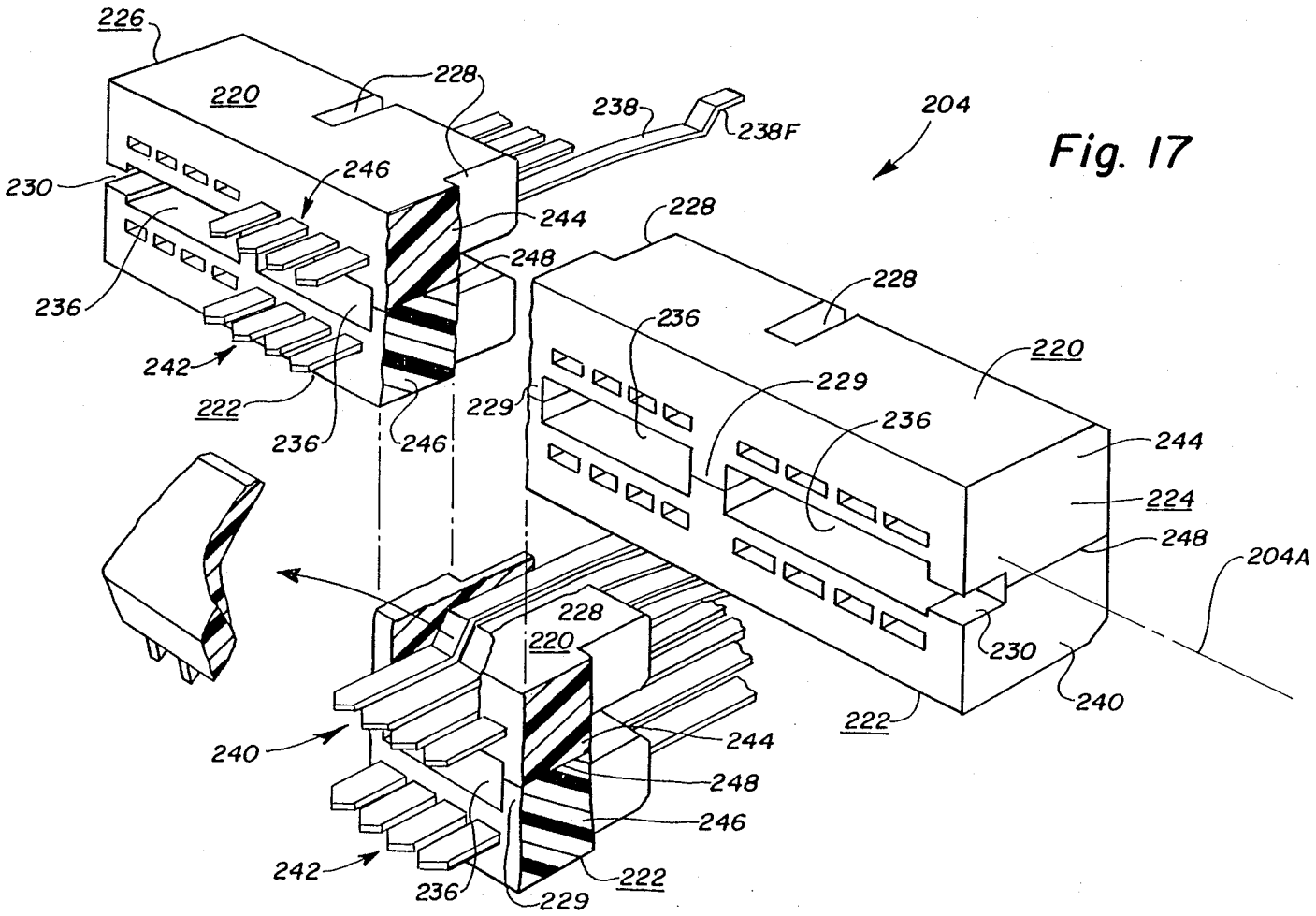
FIGS. 17, 18, and 19 are, respectively, enlarged perspective views of a contact block, housing and frame used in a receptacle shown in FIG. 14.

With reference to FIG. 16 an isolated perspective of a single contact block 204 is shown, while in FIG. 17 a pair of contact blocks 204 are shown. In the preferred case each contact block is an elongated member that is provided with upper and lower sidewalls 220, 222 and end walls 224, 226. The sidewalls 220, 222 have slots 228 formed therein, with the axis of the slots 228 extending perpendicularly to the axis 204A of the block 204. The remaining material of the block 204 directly adjacent to the slots 228 defines pillars 229.

At each of the block 204 there is provided a cutout which defines a latch space 230 in each of the end walls 224, 226, respectively. The block 204 is interrupted by spaces 236 (best seen in FIG. 17) which have a major axis that extends generally parallel to the axis of the block 204A and which are provided for a purpose to be made clear herein. A plurality of electrical contact springs 238 are embedded into the block 204 and cooperate to define a first and a second array 240, 242 of contact springs, respectively. In FIG. 17 a portion of the contact block 204 is broken to indicate the passage of the contact elements through the body of the block. The forward end of the contact spring 238 is curved, as at 238F. Each array 240, 242 of contact springs is disposed in generally parallel relationship with respect to the axis of the block with one of the arrays (e.g., the array 240) lying above a bisecting plane 243 (FIG. 14) containing the axis 204A and the other of the arrays (e.g., the array 242) lying below the bisecting plane 243 of the connector. If the receptacle of FIGS. 14 to 19 is to be used in connection with a terminator as shown in FIGS. 7 and 9, the springs 238 may be replaced by corresponding pins.

In the preferred instance the block 204 is formed by the jointure of a first and a second bar element 244 and 246, respectively. Each of the bars 244, 246 is a molded member fabricated from a plastic material. The bars 244, 246 are held to each other along a jointure line 248 when the bars 244, 246 are received within the housing 204, as will be discussed. The latch spaces 230 and the spaces 236 may be defined by registered cut outs formed in each of the bars 244, 246 if this mode of fabrication of the contact block is used. It should be appreciated, however, that the block 204 may be integrally fabricated and it is otherwise shown in FIGS. 14 and 15 as being formed as an integral member for convenience of illustration.

Figure 18:
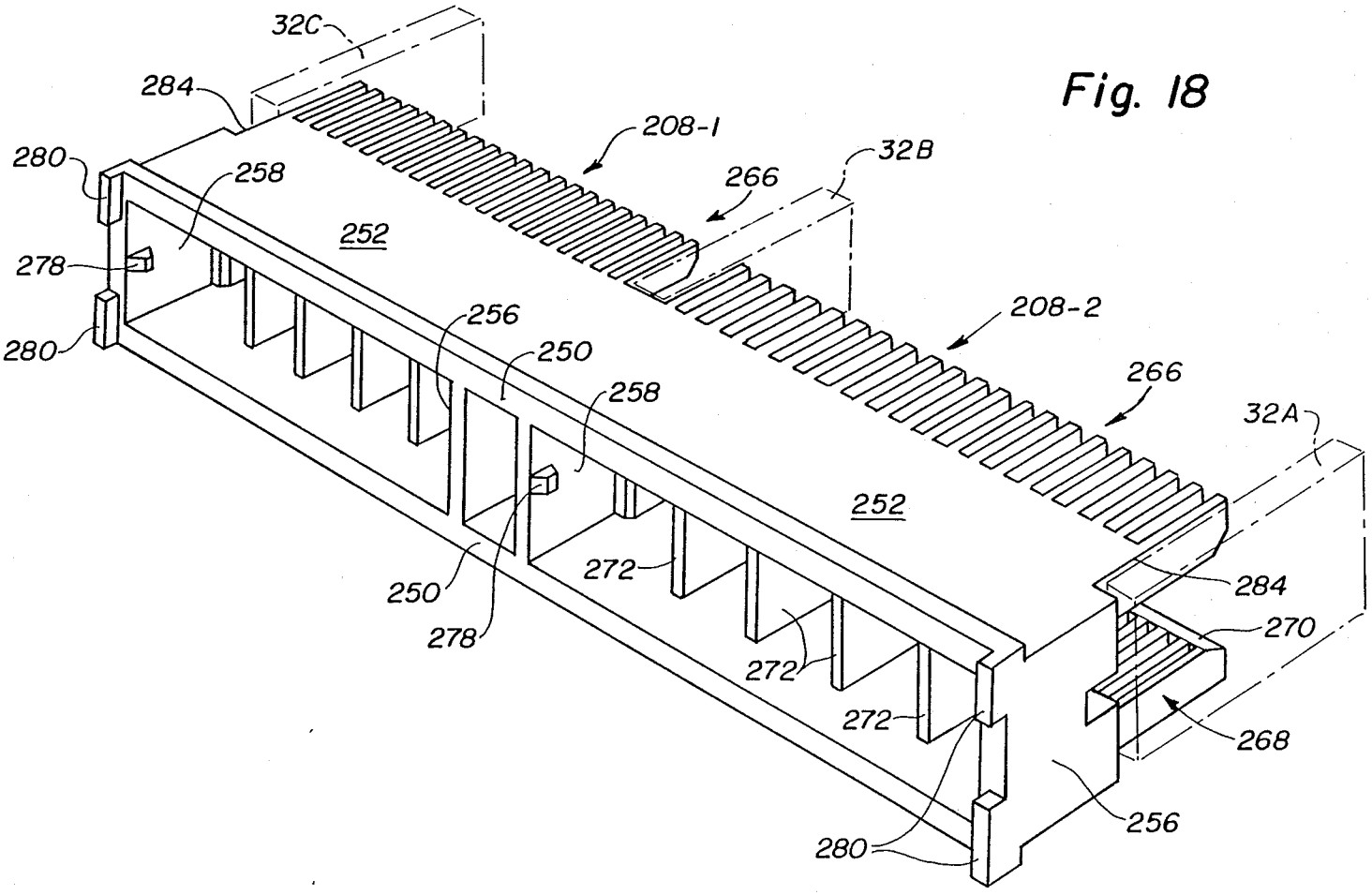
Figure 19:
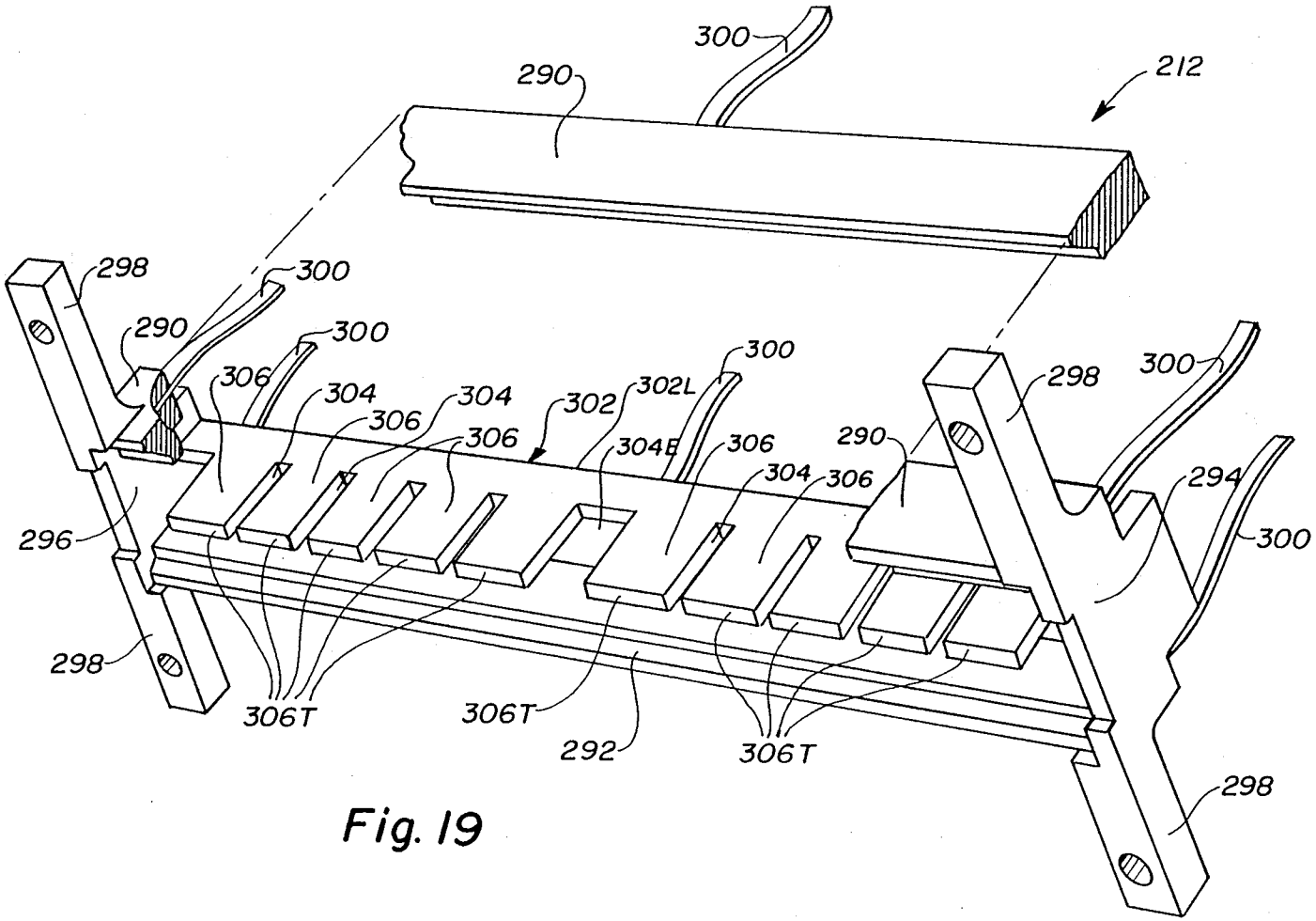

As noted earlier, the contact block 204 is received within a housing 208. FIG. 18 illustrates a perspective view of a typical arrangement for a housing. The housing 208 shown in FIG. 18 is formed from two conjoined housing sections 208-1, 208-2 connected in end to end relationship by webs 250. The structure shown in FIG. 18 may be conveniently formed by molding as an integral place. A housing section (e.g., the section 208-1) may be used singly or may form to any convenient length by molding or by connecting individual housing sections using any convenient mode of connection.

Each housing section 208 is a molded plastic member having an upper and a lower sidewall 252, 254 joined by end walls 260, 262. The forward portion of each of the sidewalls 252, 254 is provided with an array of fingers 266, 268. The fingers in each array 266, 268 are themselves joined at their forward ends by a retaining lip 260 (best seen in FIGS. 14 and 15). The sidewalls 252, 254 are joined together by ribs 272 which are spaced axially along the sidewalls. The ribs 272 serve to join the sidewall 252 to the sidewall 254 and thereby to stabilize the structure of the housing 208.

The inside surface of each of the end walls 260, 262 is provided with latches 278. In the assembled condition the block 204 is introduced into the housing 208 such that the slots 228 in the contact block 204 (FIG. 17) each accept one of the ribs 272 of the housing 208. When so arranged, each of the pillars 229 (FIG. 17) of the contact block 204 is paired with and abuts a corresponding one of the ribs 272 of the housing. The contact springs 240, 242 in the upper and lower spring arrays, respectively, project into the spaces between adjacent fingers in the upper array 266 and in the lower array 268. The curved forward ends 238F of the contact springs are retained by the lip 270, as is best seen in FIGS. 14 and 15. The block 204 is held in position in the housing 208 by the interengagement of the latches 276 on the end walls 260, 262 with the spaces 230, 232 in the end walls 224, 226. Standoffs 280 are provided at any convenient location on the housing 208.

A gap 282 is provided between the fingers in the upper array 266 and in the lower finger array 268. As will be appreciated from FIG. 16, the gap 282 is located on the housing 208 in a position that coincides with the position at which the wall 32B on the terminator 10 will lie when the terminator is introduced into the receptacle. In addition, at each end of the housing 208 there is provided a step 284, which is sized and located to accept the walls 32A, 32C on the terminator. It should be understood that the fingers in the arrays 266, 268 may be appropriately interrupted by gaps analogous to the gap 282 to correspond to the locations of the walls 32 on the ground structure of the terminator being used with the receptacle.

The remaining component of the receptacle 200 is the frame 212, illustrated in FIG. 18. The frame 212 is a generally rectangular member formed from metal or metalized plastic. The frame 212 has upper and lower crossbars 290, 292 interconnected at corresponding ends thereof by uprights 294, 296. Mounting wings 298 extend from the uprights 294, 296 to facilitate the mounting of the frame to the board B or the like. Forwardly projecting ground spring contacts 300 extend from the crossbars 290, 292 at predetermined spaced locations thereon. The location of the ground contacts 300 correspond to the locations of the gap 282 and the steps 284 on the housing 208.

A central plate 302, having a leading edge 302L thereon, extends between the uprights 294, 296 and across the frame 212. The plate 302 is disposed generally parallel to the crossbars 290, 292. The central plate 302 is provided with an array of slots 304 which define a plurality of tongues 306. The lateral dimension of the slots 304 is sized such that as the frame 212 is inserted into the housing 208 the slots 304 accept the ribs 272 formed in the housing 208 (FIG. 18) and the pillars 229 in the contact block 204 (FIG. 17). The slots 304 may be enlarged, if necessary, as shown at 304E, to accommodate the spacing between the webs 250 in the housing 208, if the same are provided.

When the frame 212 is inserted over the housing 208 the crossbars 290, 292 lie exteriorly to the surfaces 252, 254, respectively of the housing 208. In addition, the tongues 306 on the frame 212 project through the housing 208 and into the spaces 236 formed in the block 204. As seen in FIG. 14 the tips 306T of the tongues 306 extend through the block 204. When the receptacle is arranged with respect to the board B as shown in FIG. 14 the board may be provided with a ground tracing T such that the tips 306T may abut the tracing T or lie within a predetermined close distance thereof. Also, in the assembled condition of the tongues 306 of the frame suround each rib 272 and the abutted pillar 229 paired therewith.

As may be appreciated from the foregoing and as is best illustrated in FIG. 14, when the components of the receptacle are assembled the central metallic plate 302 of the frame 212 extends through the receptacle to isolate electrically the trailing portions 240T, 242T (FIG. 14) of the contact springs in the spring arrays 240, 242. The extent of the trailing portions of the contact springs 240T, 242T is best illustrated in FIG. 14. That is to say, when the central plate 302 is positioned in the receptacle and is connected to a suitable predetermined electrical potential the plate 302 forms a structure that serves to isolate the trailing portions 240T, 242T of the spring contacts in the contact arrays 240, 242 they extend through the block 204 to the board B.

Moreover, when the terminator is introduced into the assembled receptacle the leading edge surface 29 of the ground structure 22 is brought into a predetermined close adjacency or into abutted relationship with the leading edge 302L of the central plate 302. At the same time the ground contacts 300 on the frame 212 electrically engage the walls 32 on the ground structure.

When the edge 29 on the ground structure 22 is brought within a predetermined close distance of (on the order of 0.005 inch typically) or abutment with the edge 302L of the central plate 302 it should be apparent that the ground structure 22 is, in effect, extended by the action of the cental plate 302 through the receptacle. The cooperating interaction of the ground structure 22 in the terminator and the central plate 302 in the receptacle serves to electrically isolate and control the impedance of the grouped contacts on the terminator and on the receptacle.

Those skilled in the art may readily appreciate that in view of the foregoing a terminator and housing arrangement has been provided that provides efficient continuation of the shielding of the cable to the region of the terminator while at the same time permitting increased signal density to be achieved. The reader skilled in the art may also readily appreciate modifications to the structure of the terminator and/or housing as hereinabove set forth. It should be understood, however, that such modifications are to be construed as lying within the scope of the present invention as set forth in the appended claims.

What is claimed is:

1. A terminator for multiple electrical conductors, comprising:

a metallic ground structure formed of a baseplate with a plurality of upstanding walls thereon cooperating to define a predetermined number of channels arranged in side-by-side relationship across the ground structure;

an insulated support structure having a body portion with a plurality of forwardly extending fingers thereon, each of the fingers being received in one of the channels; and an electrical contact element being disposed on each of the fingers, each of the contact elements being connectable to one of the conductors so that, in use, the ground structure is connectable to a predetermined electrical potential whereby the electrical contact elements are electrically isolated from each other.

2. The terminator of claim 1 wherein the tops of the walls are spaced from the baseplate a greater distance than are the contact elements on the fingers.

3. The terminator of claim 2 wherein the multiple electrical conductors comprise conductive tracings disposed on the surface of a substrate, the terminator further comprising:

means disposed at each end of the ground structure for supporting the ground structure at the edge of the substrate.

4. The terminator of claim 1 wherein the multiple electrical conductors comprise conductive tracings disposed on the surface of a substrate, the terminator further comprising:

means disposed at each end of the ground structure for supporting the ground structure at the edge of the substrate.

5. The terminator of claim 2 wherein the multiple conductors are disposed in a cable and wherein the insulated support structure has a plurality of trenches therein, each of the trenches being adapted to receive one of the conductors of the cable.

6. The terminator of claim 1 wherein the multiple conductors are disposed in a cable and wherein the insulated support structure has a plurality of trenches therein, each of the trenches being adapted to receive one of the conductors of the cable.

7. In combination with the terminator of claim 3:

a housing having an array of lands with alternating grooves disposed between adjacent lands, a contact element being disposed on each of the lands and in each of the grooves, the contacts on the lands extending from a predetermined datum for a distance different from the distance that the contacts in the the grooves extend from the same datum, the housing being adapted to receive the ground structure such that the tops of the walls electrically engage against the contacts in the grooves in the housing while the contacts on the fingers electrically engage against the contacts on the lands.

8. In combination with the terminator of claim 5:

a housing having an array of lands with alternating grooves disposed between adjacent lands, a contact element being disposed on each of the lands and in each of the grooves, the contacts on the lands extending from a predetermined datum for a distance different from the distance that the contacts in the grooves extend from the same datum, the housing being adapted to receive the ground structure such that the tops of the walls electrically engage against the contacts in the grooves in the housing while the contacts on the fingers electrically engage against the contacts on the lands.

9. In combination with the terminator of claim 3:

a housing having an array of lands with alternating slots disposed between adjacent lands, a contact element being disposed on each of the lands and a plate on the exterior of the housing overlying at least one of the slots, the housing being adapted to receive the ground structure such that the tops of the walls electrically engage against the plates while the contacts on the fingers electrically engage against the contacts on the lands.

10. In combination with the terminator of claim 5:

a housing having an array of lands with alternating slots disposed between adjacent lands, a contact element being disposed on each of the lands and a plate on the exterior of the housing overlying at least one of the slots, the housing being adapted to receive the ground structure such that the tops of the walls electrically engage against the plates while the contacts on the fingers electrically engage against the contacts on the lands.

11. A terminator for a multiconductor cable, comprising:

a casing;

a metallic ground structure disposed within the casing, a portion of the ground structure projecting forwardly from the casing, the projecting portion of the ground structure having a plurality of upstanding walls thereon cooperating to define a predetermined number of channels arranged in side-by-side relationship across the ground structure, the axes of the channels lying in generally parallel relationship;

an insulated support structure having a body portion with a corresponding predetermined number of forwardly extending fingers thereon, each of the fingers being received in one of the channels; and an electrical contact element being disposed on each of the fingers, each of the contact elements being connectable to one of the conductors in the multiconductor cable, the tops of the walls extending above the contact elements on the fingers so that, in use, the ground structure is connectable to a predetermined electrical potential whereby the electrical contacts are electrically isolated from each other.

12. The terminator of claim 11 wherein the insulating support structure further comprises an array of trenches disposed in the body portion thereof, each of the trenches being sized to receive an individual one of the electrical conductors therein.

13. The terminator of claim 12 wherein the ground structure has a post thereon that engages against the interior of the casing to space the remainder of the ground structure from the casing.

14. The terminator of claim 11 wherein the ground structure has a post thereon that engages against the interior of the housing to space the remainder of the ground structure from the housing.

15. The terminator of claim 13 wherein the casing has a conductive surface on the interior thereof and wherein the post is fabricated of a conductive material so that the conductive surface on the interior of the casing and the ground structure are in electrical contact with each other.

16. The terminator of claim 14 wherein the casing has a conductive surface on the interior thereof and wherein the post is fabricated of a conductive material so that the conductive surface on the interior of the casing and the ground structure are in electrical contact with each other.

17. In combination with the terminator of claim 11, a housing for receiving the terminator, the housing comprising:

a body fabricated of an insulating material, the body having an array of grooves each separated by an adjacent land, the grooves and the lands extending substantially parallel to each other; and an electrical contact element disposed in each of the grooves and on each of the lands such that each of the contact elements on the lands extends a greater distance from a predetermined reference datum than does each of the contacts in the grooves and such that, when conjoined with the terminator, the contact elements in the grooves electrically engage against the walls of the ground structure and the contact elements on the lands electrically engage against the contact elements on the fingers of the support structure.

18. In combination with the terminator of claim 11, a housing for the plug comprising:

a body fabricated of an insulating material, the body having an array of grooves each separated by an adjacent slot, the grooves and the slots extending substantially parallel to each other; and an electrical contact element disposed in each of the grooves and a conductive plate overlying at least one of the slots such that each of the contact elements on the lands extends a greater distance from a predetermined reference datum than does the plate and such that, when conjoined with the plug, the plate overlying the slot electrically engages against a wall of the ground structure and the contact elements on the lands electrically engage against the contact elements on the fingers of the support structure.

19. A terminator for a multiconductor substrate, comprising:

a metallic ground structure having a plurality of upstanding walls thereon cooperating to define a plurality of channels arranged in side-by-side relationship across the ground structure;

an insulated support structure having a body portion with a plurality of forwardly extending fingers thereon, each of the fingers being received in one of the channels;

an electrical contact element being disposed on each of the fingers, each of the contact elements being connectable to one of the conductors on the multiconductor substrate, the tops of the walls extending above the contact elements on the fingers; and a mounting bracket disposed on the ground to mount the ground structure to the surface of the substrate so that, in use, the ground structure is connectable to a predetermined electrical potential whereby the electrical contacts are electrically isolated from each other.

20. In combination with the terminator of claim 19, a housing for receiving the ground structure, the housing comprising:

a body fabricated of an insulating material, the body having an array of grooves each separated by an adjacent land, the grooves and the lands extending substantially parallel to each other; and an electrical contact element disposed in each of the grooves and on each of the lands such that each of the contact elements on the lands extends a greater distance from a predetermined reference datum than does each of the contacts in the grooves and such that, when conjoined with the ground structure, the contact elements in the grooves electrically engage against the walls of the ground structure and the contact elements on the lands electrically engage against the contact elements on the fingers of the support structure.

21. In combination with the terminator of claim 19, a housing for the ground structure, the housing comprising:

a body fabricated of an insulating material, the body having an array of grooves each separated by an adjacent slot, the grooves and the slots extending substantially parallel to each other; and an electrical contact element disposed in each of the grooves and an conductive plate overlying at least one of the slots such that each of the contact elements on the lands extends a greater distance from a predetermined reference datum than does the plate and such that, when conjoined with the ground structure, the plate overlying the slot electrically engages against a wall of the ground structure and the contact elements on the lands electrically engage against the contact elements on the fingers of the support structure.

22. A terminator for mulitple electrical conductors comprising:

a metallic ground structure formed of a baseplate having an upper and a lower surface thereon, a plurality of upstanding walls extending from each of the upper and lower surfaces of the baseplate, the walls on each surface cooperating to define a predetermined number of channels arranged in side-by-side relationship across each surface of the ground structure;

a first and a second insulated support structure each having a body portion with a plurality of forwardly extending fingers thereon, one of the support structures being disposed on one of the surfaces of the ground structure, each of the fingers on each of the support structures being received in one of the channels on the ground structure; and an electrical contact element being disposed on each of the fingers, each of the contact elements being connectable to one of the conductors, the tops of the walls of the ground structure being spaced above the surface thereof to a greater extent than the contact elements on the fingers are spaced thereabove so that, in use, the ground structure is connectable to a predetermined electrical potential whereby the electrical contact elements are electrically isolated from each other.

23. In combination with the terminator of claim 22, a housing for the ground structure, the housing comprising:

a body fabricated of an insulating material, the body having an upper and a lower array of lands each separated by an adjacent groove, the lands and the grooves extending substantially parallel to each other; and an electrical contact element disposed on each of the lands and in each of the grooves such that each of the contact elements on the lands extends a greater distance toward a predetermined reference datum disposed at the center of the housing than does each of the contacts in the grooves, and such that when conjoined with the ground structure the contact elements in the upper and lower grooves respectively electrically engage against the tops of the walls on the upper and lower surfaces of the ground structure and the contact elements on the lands respectively electrically engage against the contact elements on the fingers of the first and second support structures.

24. In combination with the terminator of claim 22, a housing for the ground structure, the housing comprising:

a body fabricated on an insulating material, the body having an upper and a lower array of lands each separated by an adjacent slot, the lands and the slots extending substantially parallel to each other; and an electrical contact element disposed on each of the lands and an array of conductive plates each overlying each of the slots such that each of the contact elements on the lands extends a greater distance toward the center of the housing than does each of the plates, and such that when conjoined with the ground structure the contact elements in the upper and lower lands respectively electrically engage against the contact elements on the fingers of the first and second support structures and the plates electrically engage aginst the tops of the walls on the first and second support structures.

25. A housing for receiving a terminator, comprising:

a body fabricated of an insulating material, the body having an opening therein, the body having an array of grooves each separated by an adjacent land, the grooves and the lands extending substantially parallel to each other, each of the lands having a surface thereon, the lands extending a predetermined distance into the opening such that no portion of the body between the grooves extends into the opening past the surfaces of the lands; and an electrical contact element disposed in each of the grooves and at least one contact element being disposed on each of the lands such that each of the contact elements on the lands extends a greater distance from a predetermined reference datum than does each of the contact elements in the grooves.

26. A housing for receiving a terminator, comprising:

a body fabricated of an insulating material, the body having an opening therein, the opening being sized to accept the terminator, the body having an array of lands each separated by an adjacent slot, the lands and the slots extending substantially parallel to each other, all of the lands communicating with the opening; and at least one electrical contact element disposed on each of the lands and communicating with the opening; and conductive plate overlying at least one of the slots such that each of the contact elements on the lands extends a greater distance from a predetermined reference datum than does the plate overlying the slot.

27. A terminator for multiple electrical conductors, comprising:

a metallic ground structure formed of a baseplate with a plurality of upstanding walls thereon cooperating to define a predetermined number of channels arranged in side-by-side relationship across the ground structure;

an insulated support structure having a body portion with a plurality of forwardly extending fingers thereon, each of the fingers having a recess therein, each of the fingers being received in one of the channels; and an electrical contact element being disposed within the recess of each of the fingers, each of the contact elements being connectable to one of the conductors so that, in use, the ground structure is connectable to a predetermined electrical potential whereby the electrical contact elements are electrically isolated from each other.

28. The terminator of claim 27 wherein the insulated support structure has a forward face, further comprising:

a casing surrounding the support structure, the casing having a forward edge, the forward edge of the casing being coextensive with the forward face of the insulated support structure.

29. A terminator for mulitple electrical conductors, comprising:

a metallic ground structure formed of a baseplate with a plurality of upstanding walls thereon cooperating to define a predetermined number of channels arranged in side-by-side relationship across the ground structure;

an insulated support structure having a body portion with a plurality of forwardly extending fingers thereon;

a group comprised of two or more electrical contact elements disposed on each of the fingers, each of the contact elements in each group being connectable to one of the conductors so that, in use, the ground structure is connectable to a predetermined electrical potential whereby the contact elements in each group of contact elements are electrically isolated from the contact elements in the other groups.

30. A terminator for multiple electrical conductors, comprising:

a metallic ground structure formed of a baseplate with at least one upstanding wall thereon defining a predetermined number of channels arranged in side-by-side relationship across the ground structure;

an insulated support structure having a body portion with a plurality of forwardly extending fingers thereon, each of the fingers having a recess therein, each of the fingers being received in one of the channels; and a group comprised of two or more electrical contact elements disposed within the recess of each of the fingers, each of the contact elements in each other being connectable to one of the conductors so that, in use, the ground structure is connectable to a predetermined electrical potential whereby the contact elements in each group of contact elements are electrically isolated from the contact elements in the other groups.

31. The terminator of claim 30 wherein the insulated support structure has a forward face, further comprising:

a casing surrounding the support structure, the casing having a forward edge, the forward edge of the casing being coextensive with the forward face of the insulated support structure.

32. A terminator for a first and a second electrical conductor, comprising:

a metallic ground structure formed of a baseplate with at least one upstanding wall thereon, the baseplate and the wall cooperating to define at least a first and a second channel arranged in side-by-side relationship across the ground structure;

an insulating support structure having at least a first and a second finger thereon, each of the fingers being received in one of the channels; and at least one electrical contact element being disposed on each of the fingers, each of the contact elements being connectable to one of the conductors, the terminator being arranged such that, in use, the ground structure is connectable to a predetermined electrical potential whereby the electrical contact elements are electrically isolated from each other.

33. The terminator of claim 32 wherein the top of the wall is spaced from the baseplate a greater distance than are the contact elements on the fingers.

34. The terminator of claim 33 wherein there are plural contacts disposed on each finger.

35. The terminator of claim 32 wherein there are plural contacts disposed on each finger.

36. The terminator of claim 33 wherein each of the fingers has a recess disposed therein, each of the electrical contacts being disposed within a recess.

37. The terminator of claim 32 wherein each of the fingers has a recess disposed therein, each of the electrical contacts being disposed in a recess.

38. The terminator of claim 36 wherein there are plural contacts disposed on each finger, each contact being disposed in a recess.

39. The terminator of claim 37 wherein there are plural contacts disposed on each finger, each contact being disposed in the recess in the finger.

* * * * *